US006580665B1

(12) United States Patent
Kamiyama et al.

(10) Patent No.: US 6,580,665 B1
(45) Date of Patent: Jun. 17, 2003

(54) ELECTRONIC TIMEPIECE HAVING POWER GENERATING FUNCTION

(75) Inventors: Yasuo Kamiyama, Tanashi (JP); Tomomi Murakami, Tanashi (JP); Masao Mafune, Tanashi (JP); Yoichi Nagata, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/547,038

(22) Filed: Apr. 11, 2000

Related U.S. Application Data

(63) Continuation of application No. PCT/JP99/04714, filed on Aug. 31, 1999.

(30) Foreign Application Priority Data

Aug. 31, 1998 (JP) ..... 10-244916
Sep. 24, 1998 (JP) ..... 10-269704

(51) Int. Cl.[7] ..... G04B 47/66; G04B 9/00; G04B 1/00; G04C 23/00

(52) U.S. Cl. ..... 368/66; 368/204; 368/238

(58) Field of Search ..... 368/76, 80, 64, 368/66, 203, 205, 238, 204

(56) References Cited

U.S. PATENT DOCUMENTS 3,998,043 A * 12/1976 Tamaru et al. ..... 368/203
4,037,399 A * 7/1977 Chihara ..... 368/203
4,316,274 A * 2/1982 Ushikoshi ..... 368/203
5,001,685 A * 3/1991 Hayakawa ..... 368/203
5,446,702 A * 8/1995 Mossuz et al. ..... 368/66
5,701,278 A * 12/1997 Higuchi et al. ..... 368/204
5,705,770 A * 1/1998 Ogasawara et al. ..... 368/204
5,790,478 A * 8/1998 Besson ..... 368/66
5,889,736 A * 3/1999 Fujita et al. ..... 368/66
5,940,348 A * 8/1999 Murakami et al. ..... 368/66
5,978,318 A * 11/1999 Kawaguchi et al. ..... 368/66
6,051,957 A * 4/2000 Klein ..... 320/132
6,061,304 A * 5/2000 Nagata et al. ..... 368/66
6,097,675 A * 8/2000 Takahashi et al. ..... 368/204
6,122,226 A * 9/2000 Murakami et al. ..... 368/205
6,144,621 A * 11/2000 Sase ..... 368/205
6,147,936 A * 11/2000 Nakajima ..... 368/205
6,278,663 B1 * 8/2001 Okeya et al. ..... 368/203

FOREIGN PATENT DOCUMENTS

JP 53-158273 12/1978
JP 57-76470 5/1982
JP 59-137590 9/1984
JP 60-74079 5/1985
JP 62-100685 5/1987
JP 62-177054 11/1987
JP 63-186536 8/1988
JP 4-80689 3/1992
JP 5-80165 4/1993
JP 10-186064 7/1998

* cited by examiner

*Primary Examiner*—Vit Miska
*Assistant Examiner*—Jeanne-Marguerite Goodwin
(74) *Attorney, Agent, or Firm*—Kanesaka & Takeuchi

(57) ABSTRACT

An electronic timepiece is formed of a power generating device for generating power, a control device for driving on receipt of a power supply from the power generating device, a display device for displaying a time by an operation of the control device, a detecting device for detecting a state of the power generating device, and a deciding device for deciding whether or not the power generating device generates power based on a detection signal sent from the detecting device. The control device controls such that a power generating state of the power generating device is displayed on the display device based on a decision of the deciding device. It is possible to reduce power consumption by stopping hands if required.

27 Claims, 14 Drawing Sheets

ELECTRONIC TIMEPIECE HAVING POWER GENERATING FUNCTION

CROSS REFERENCE TO RELATED APPLICATION

This is a continuation application of PCT International Application of PCT/JP99/04714 filed on Aug. 31, 1999.

TECHNICAL FIELD

The present invention relates to an electronic timepiece having a power generating function of detecting the power generating state of power generating means, thereby causing a display section to display a detection state, and more particularly to an electronic timepiece having a power generating function of detecting whether a state in which the power generating means generates power or a state in which the power generating means does not generate power, thereby causing display means to display the state.

BACKGROUND ART

There has been known an electronic timepiece including power generating means for converting an external energy such as a light energy or a mechanical energy into power to be utilized for time display.

Examples of the power generating means include power generation by a solar cell or the kinetic energy of a oscillating weight, power generation by a difference in a temperature on both terminals of a thermocouple and the like.

The electronic timepiece having such power generating means generally has storage means for storing power generated by the power generating means, for example, a secondary battery or a capacitor.

There has been practically used an electronic timepiece for displaying the storage level of the storage means (the residual storage level) by a modulated hand motion with changing a hand moving mode and the like, for example. Japanese Patent Application Laid-Open (JP-A) No. 60-185188 has disclosed an electronic timepiece for displaying the storage level by such a modulated hand motion.

Furthermore, Japanese Patent Publication (JP-B) No. 7-89154 and the like have disclosed an electronic timepiece for stopping a hand motion when the storage level is very low and for restarting the hand motion to perform time display when the storage level is recovered to a predetermined level or more by subsequent charging.

With reference to FIG. 15, description will be given to an electronic timepiece having a power generating function of the prior art.

FIG. 15 is a block diagram illustrating the structure of a circuit of an electronic timepiece having a power generating function of the prior art.

Storage means 720 such as a lithium ion secondary battery and control means 750 having a timing function are connected in parallel with power generating means 710 which is a solar cell. Moreover, control means 730 having a diode 732 is provided among the storage means 720, the control means 750 and the power generating means 710. The control means 730 serves to control the charging or storage of the storage means 720.

The control means 750 for timing serves to move an hour hand, a minute hand and a second hand by using a stepping motor and a decelerating train wheel and is generally used for an electronic timepiece.

To the negative electrode side of the storage means 720 is connected storage level detecting means 742 for measuring a difference in an electric potential between the terminals of the storage means 720 and comparing the difference in an electric potential between the terminals with a predetermined difference in an electric potential. The detecting means 742 is an amplifier circuit for outputting a high level (1) when an input voltage is higher than 1.3 V and otherwise outputting a low level (0).

In FIG. 15, a signal output from the detecting means 742 is indicated as the reference numeral S20. The detecting means 720 decides that the storage level is sufficient when the signal S20 is indicative of the high level. At this time, an ordinary one-second hand motion is carried out (by one-step to be performed every second). The detecting means 720 decides that the storage level is low when the signal S20 is indicative of the low level. The hand motion to be performed at this time is a two-second hand motion (a two-step hand motion to be performed at a short interval of 2 seconds, such a hand motion which is different from an ordinary hand motion is referred to as a modulated hand motion).

In the electronic timepiece described above, when the power generating means 710 starts power generation, a current mainly flows from the power generating means 710 to the storage means 720 through the diode 732 and the storage means 720 is charged.

When the storage level of the storage means 720 reaches approximately 1.0 V which is enough to operate a step motor of the control means 750 which is not shown, the control means 750 is started so that the hand motion is started to be operated. In this case, the storage voltage of the storage means 720 has not reached 1.3 V yet. Therefore, the signal S20 is indicative of the low level and the two-second hand motion is carried out.

When the power generation of the power generating means 710 is consecutively carried out and the storage means 720 is continuously charged, an absolute value of the difference in the electric potential between the terminals of the storage means 720 exceeds 1.3 V. When the absolute value of the difference in the electric potential exceeds 1.3 V, the signal S20 is indicative of the high level and the hand motion is switched into the one-second hand motion in the ordinary state by the control means 750.

Since, such an electronic timepiece detects the storage level of the storage means 720 to control the hand motion and informs a user whether the hand motion can be surely performed based on the detected storage level, it is convenient.

In the above-mentioned electronic timepiece according to the prior art, however the warning of the residual storage level of the storage means 720 by the modulated hand motion makes no difference during power generation and non-power generation. Therefore, even if it can be known that the storage means 720 is fully stored, it cannot be known whether or not the power generating means 710 generates power well. Moreover, even if the power generation is performed by the power generating means 710, the modulated hand motion is continued until the storage level of the storage means 720 becomes predetermined level or more. Therefore, the hand motion different from the ordinary hand motion is carried out for a comparatively long period of time, so that it makes the users anxious.

For amusing, in the case where the user wants to show that his or her electronic timepiece which looks like an ordinary timepiece has a power generating function or the user wants to ascertain that the power generating means 710 is normally operated, it is impossible to meet such a user's demand.

In addition, when the electronic timepiece according to the prior art is left for a comparatively long period of time, the storage level of the storage means reaches approximately 0 so that the electronic timepiece does not perform as a timepiece. For this reason, it is necessary to cause the power generating means to function in use, thereby storing power in the storage means and then performing timing. In recent years, however, there has been required an electronic timepiece which does not have a time display function even if it is left for a longer period of time.

In order to solve the above-mentioned problem, it is an object of the present invention to provide an electronic timepiece having a power generating function which can immediately be seen as to whether or not the power generating means is set in a power generating state or a non-power generating state. Moreover, it is another object of the present invention to provide an electronic timepiece having a power generating function which can indicate the charging state of storage means. It is a further object of the present invention to provide an electronic timepiece having a power generating function which can control the level of consumed power based on the levels of power generation and storage, thereby keeping a time display function even if the electronic timepiece is left for a long period of time.

DISCLOSURE OF THE INVENTION

In order to achieve the above-mentioned object, the present invention provides an electronic timepiece having a power generating function comprising power generating means, control means for working on receipt of power supply from the power generating means, and display means for displaying a time by the work of the control means, comprising detecting means for detecting a state of the power generating means and deciding means for deciding whether or not the power generating means generates power based on a detection signal sent from the detecting means, wherein the power generating state is displayed on the display means based on the decision of the deciding means.

Whether or not the power generating means generates power can be decided based on the difference in an electric potential between both terminals of the power generating means. For example, whether a power generating state capable of gaining sufficient power can be known as whether or not an absolute value of the difference in an electric potential is greater than a predetermined value. It is also possible to provide storage detecting means for detecting the storage level of the storage means.

The display of the power generating state can be carried out by the modulated hand motion of a hand in an analog type timepiece, and by digitally displaying a mark or the like in a digital type timepiece.

Consequently, the electronic timepiece according to the present invention can inform a user whether or not the power generating means generates power by the change of the hand motion state or the display of the display section.

Moreover, the time display operation of the control means may be changed depending on the generated power level by the power generating means. It is preferable that the absolute value of the difference in an electric potential between the terminals of the power generating means should be compared with a predetermined value, thereby changing the time display operation. The time display operation may be changed depending on the storage level of the storage means.

Consequently, it is also possible to display the level of power generation of the power generating means and the storage level (the residual storage level) of the storage means.

Moreover, the storage level of the storage means can particularly be detected. For example, consequently, also in the case where the storage level of the storage means is very low, an ordinary hand motion can also be carried out if the power generating means continuously supplies a predetermined power level.

Furthermore, it is also possible to provide switch means for selectively switching the supply of power from the power generating means into the detecting means. The switching means can perform switching automatically or manually.

Consequently, when the power generating state of the power generating means is detected, the supply of the power from the power generating means to the storage means or the control means can be blocked.

Moreover, when the absolute value of the generated power level by the power generating means and/or the power level stored in the storage means is smaller than a predetermined value, a part of the time display operation or the whole time display operation to be performed by the control means can be stopped in order to reduce the power consumption. It is preferable that a second hand or all the hands should be stopped to reduce the power consumption. In this case, it is preferable that the second hand should be first stopped and all the hands should be stopped after the passage of a predetermined time.

With such a structure, in the case where the generated power level by the power generating means and/or the storage level of the storage means are reduced, the power consumption can be suppressed. Moreover, even if the power generating means does not generate power, a time display function can be kept for a long period of time. When the electronic timepiece is to be used after it is left for a long period of time, it is possible to quickly move the hand, thereby displaying an accurate present time.

BEST MODE FOR CARRYING OUT THE INVENTION

With reference to the drawings, preferred embodiments of an electronic timepiece according to the present invention will be described in detail.

Figure 1A:
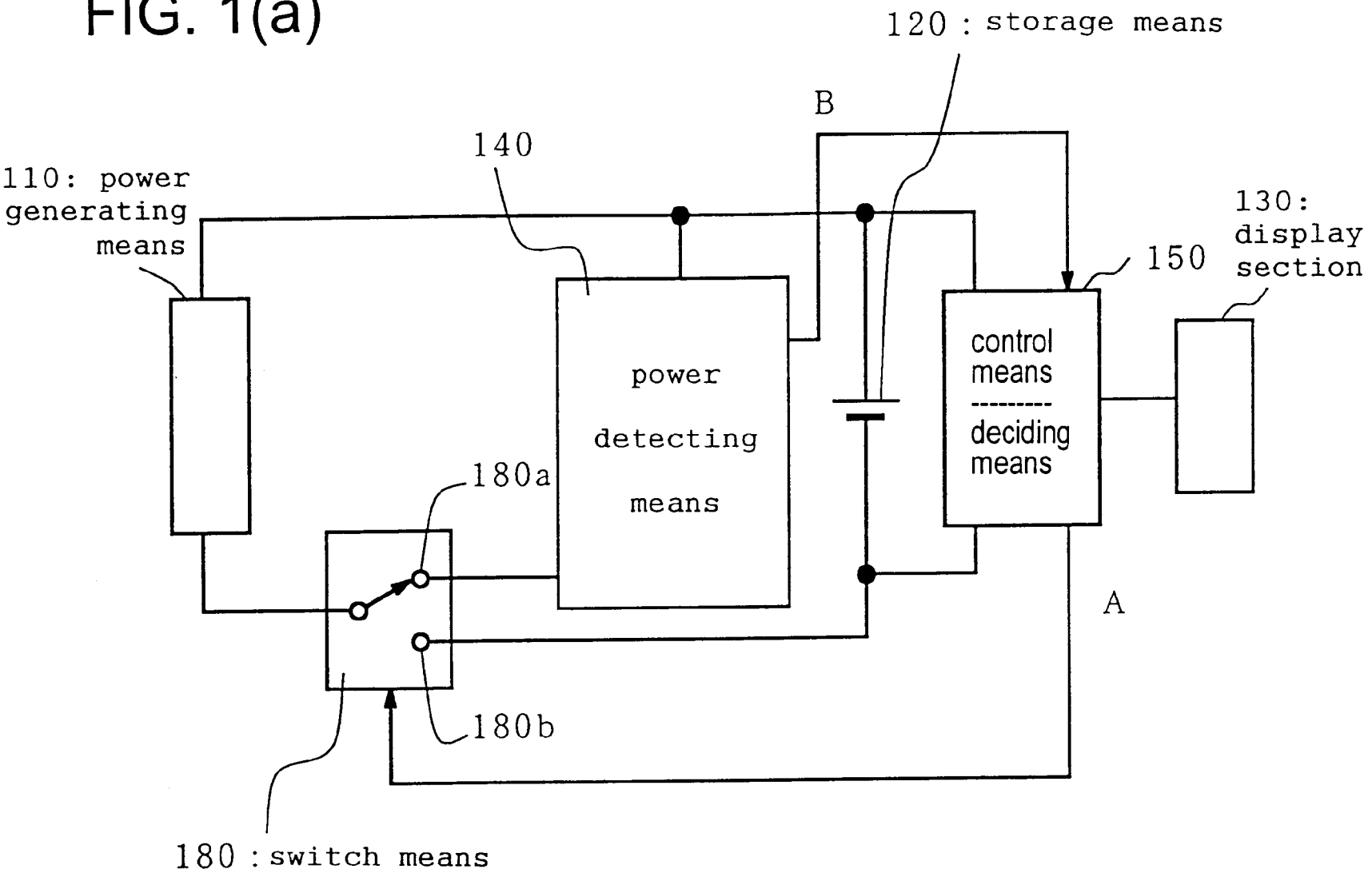
FIGS. 1(*a*) and 1(*b*) are block diagrams illustrating an electronic timepiece according to a first embodiment of the present invention, wherein FIG. 1(*a*) shows a state in which switch means is switched to detect a difference in an electric potential between the terminals of power generating means, and FIG. 1(*b*) shows a state in which the switch means is switched to supply power generated by the power generating means to the storage means.
Figure 1B:
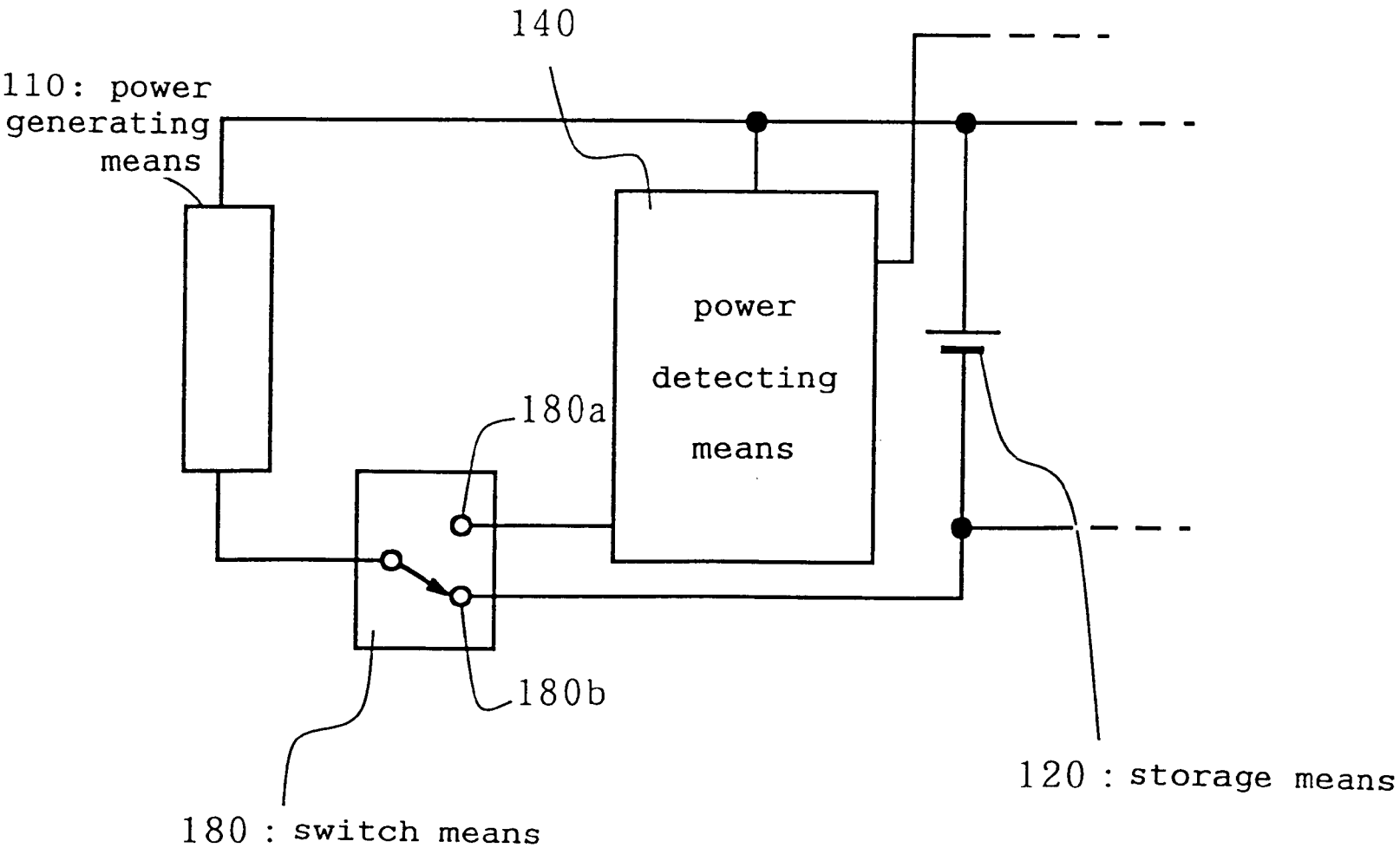

FIGS. 1(*a*) and 1(*b*) are block diagrams illustrating an electronic timepiece according to a first embodiment of the present invention. FIG. 1(*a*) shows a state in which switch means is switched to detect a difference in an electric potential between the terminals of power generating means, and FIG. 1(*b*) shows a state in which the switch means is switched to supply power supplied from the power generating means to the storage means.

As shown in FIGS. 1(*a*) and 1(*b*), the electronic timepiece comprises power generating means 110 acting as a primary power source having a power generating function such as a solar cell or a temperature difference power generator, storage means 120 including a secondary battery or a capacitor, a display section 130 for displaying a time or the like, power detecting means 140 for detecting the power generating state of the power generating means 110 based on a difference in an electric potential between both terminals of the power generating means 110, control means 150 for time display which includes deciding means for outputting a display signal to the display section 130 based on the result of detection of the power detecting means 140, and switch means 180 for switching a path so as to selectively supply power from the power generating means 110 to the power detecting means 140 or the storage means 120 and/or the control means 150.

The power detecting means 140 includes a differential voltmeter which is not shown. The differential voltmeter transmits a detection signal B to the control means 150 when an absolute value of the difference in an electric potential between both terminals of the power generating means 110 is greater than a predetermined value (for example, 1.0 V).

The switch means 180 has a terminal 180*a* for causing a signal line connecting the power generating means 110 and the power detecting means 140 to be conducted and a terminal 180*b* for causing a signal line connecting the power generating means 110 and the storage means 120 to be conducted. The switch means 180 switches the signal line in response to a timing signal A sent from the control means 150.

Whether or not the power generating means 110 is set in a power generating state is detected in an output timing of the timing signal A. The output timing of the timing signals A can be set optionally, for example, every four seconds.

The above-mentioned electronic timepiece is operated in the following manner.

In the switch means 180, a current usually flows from the power generating means 110 to the storage means 120 through the terminal 180*b* as shown in FIG. 1(*b*). Accordingly, the power generated by the power generating means 110 is supplied to the storage means 120. The control means 150 is operated by the power stored in the storage means 110, thereby causing the display section 130 to display a time.

Next, the predetermined timing signal generated by the control means 150 is output as the signal A, and is sent to the switch means 180. In response to the signal A, the signal line is switched from the terminal 180*b* side to the terminal 180*a* side as shown in FIG. 1(*a*).

Consequently, both terminals of the power generating means 110 and the power detecting means 140 are conducted so that a difference in an electric potential between the both terminals of the power generating means 110 can be detected.

When the power generating means 110 generates power, the difference in an electric potential between the both terminals of the power generating means 110 appears and the detection signal B is sent to the control means 150. When the absolute value of the difference in an electric potential is greater than the predetermined value, a command signal is sent from the control means 150 to the display section 130. Consequently, the display section 130 displays, in a predetermined display mode, that the power generating means 110 is set in the power generating state.

Next, description will be given to the display mode for displaying that the power generating means 110 generates power with reference to FIGS. 2 to 5(*b*).

Figure 2:
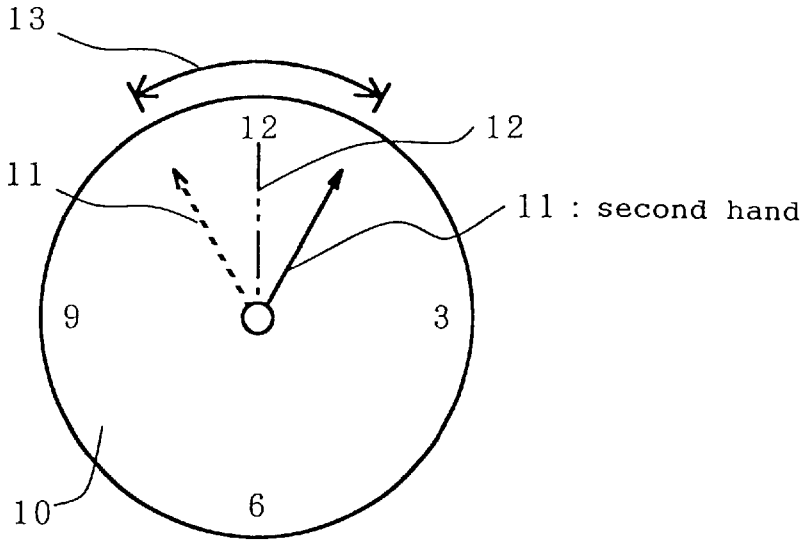
FIG. 2 is a plan view showing an example of the display mode of the electronic timepiece, the electronic timepiece comprising two stepping motors for driving an hour hand and a minute hand and for driving a second hand in a movement.

FIG. 2 is a plan view showing an example of the display mode of the electronic timepiece. The electronic timepiece shown in FIG. 2 comprises two stepping motors (not shown) for driving a hour hand and a minute hand and for driving a second hand in a movement.

An electronic timepiece 10 uses a second hand 11 for displaying the state. The electronic timepiece 10 oscillates the second hand 11 circularly in the directions of arrows 13 around the position of 12 o'clock shown in a two-dotted chain line 12, for example, within a range of ±5 seconds.

Figure 3:
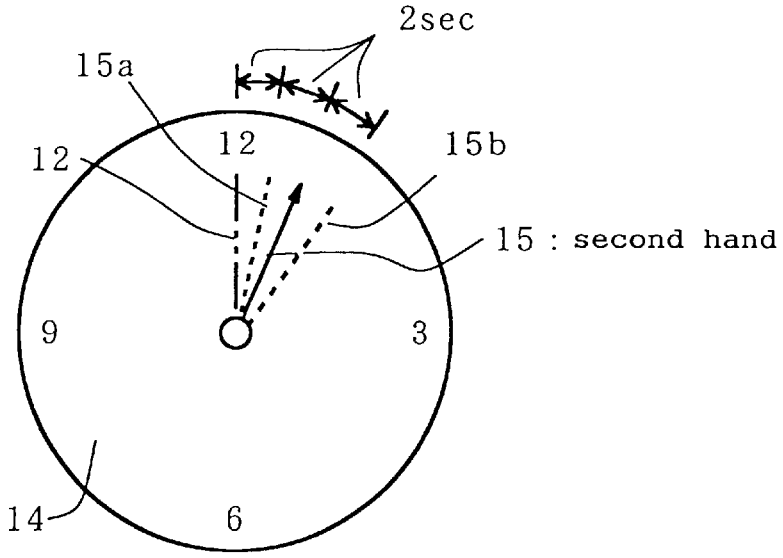
FIG. 3 is a plan view showing another example of the display mode in the electronic timepiece.

FIG. 3 is a plan view showing another display mode of the electronic timepiece.

An electronic timepiece 14 has only one stepping motor (not shown) for a hand motion in the movement. In this case, a second hand 15 cannot be oscillated. Therefore, a so-called two-second hand motion for moving the second hand every two seconds or a two-second irregular hand motion for irregularly moving the second hand every two seconds is carried out. For example, when the second hand reaches the position shown in the two-dotted chain line 12, the second hand is stopped for two seconds and is quickly transferred to a position shown in a dotted line 15*a* after the passage of two seconds. In this position, the second hand is stopped for two seconds and is transferred to the position of the second hand 15 shown in a solid line after the passage of two seconds. Similarly, the second hand is transferred to a position shown in a dotted line 15*b* after two seconds pass.

Figure 4:
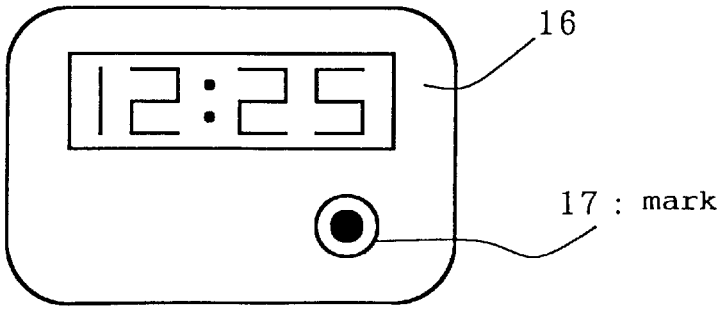
FIG. 4 illustrates an example of the display mode in which the present invention is applied to a digital electronic timepiece.

FIG. 4 shows an example of the display mode obtained by applying the present invention to a digital electronic timepiece. A mark 17 is displayed on the display section of an electronic timepiece 16, thereby displaying that the power generating means 110 is set in a power generating state or not. The mark 17 is turned on when the power generating means 110 is set in the power generating state, and is turned off when the power generating means 110 is not set in the power generating state.

Figure 5A:
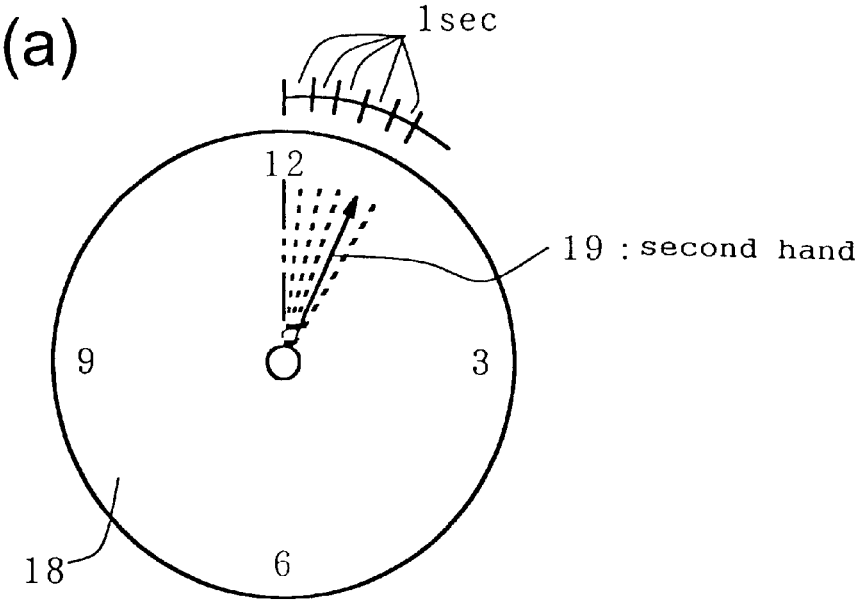
FIGS. 5(*a*) and 5(*b*) are plan views showing a further example of the display mode in an electronic timepiece of a hand display type.
Figure 5B:
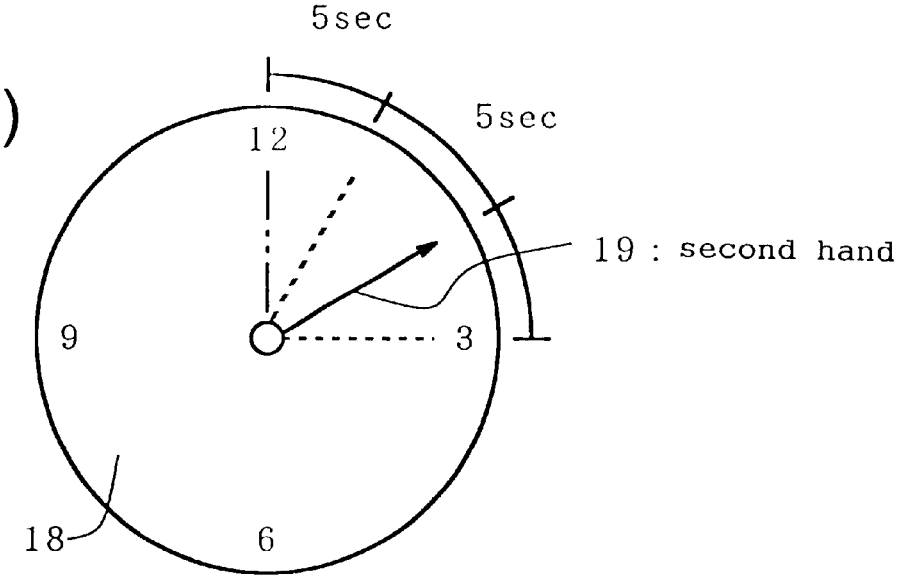

FIGS. 5(*a*) and 5(*b*) are plan views showing an electronic timepiece of a hand display type according to another example of the display mode. In particular, this example is effective in an electronic timepiece having power generating means depending on a temperature difference.

FIG. 5(*a*) shows a display mode obtained when an electronic timepiece 18 is worn to an arm to bring the power generating means 1 shown in FIG. 1(*a*) into the power generating means. A second hand 19 performs an ordinary one-second hand motion. FIG. 5(*b*) shows a state in which the electronic timepiece 18 is removed from the arm to cause the power generating means 110 to stop the power generation. The second hand 19 performs a five-second hand motion, for example, which is much more different from the one-second hand motion.

In the above description, it has been assumed that the switch means 180 is automatically switched in response to the signal A sent from the control means 150. However, the switch means 180 can also be switched manually. Description will be given to the case where the operation of the switch means 180 is carried out manually.

Figure 6:
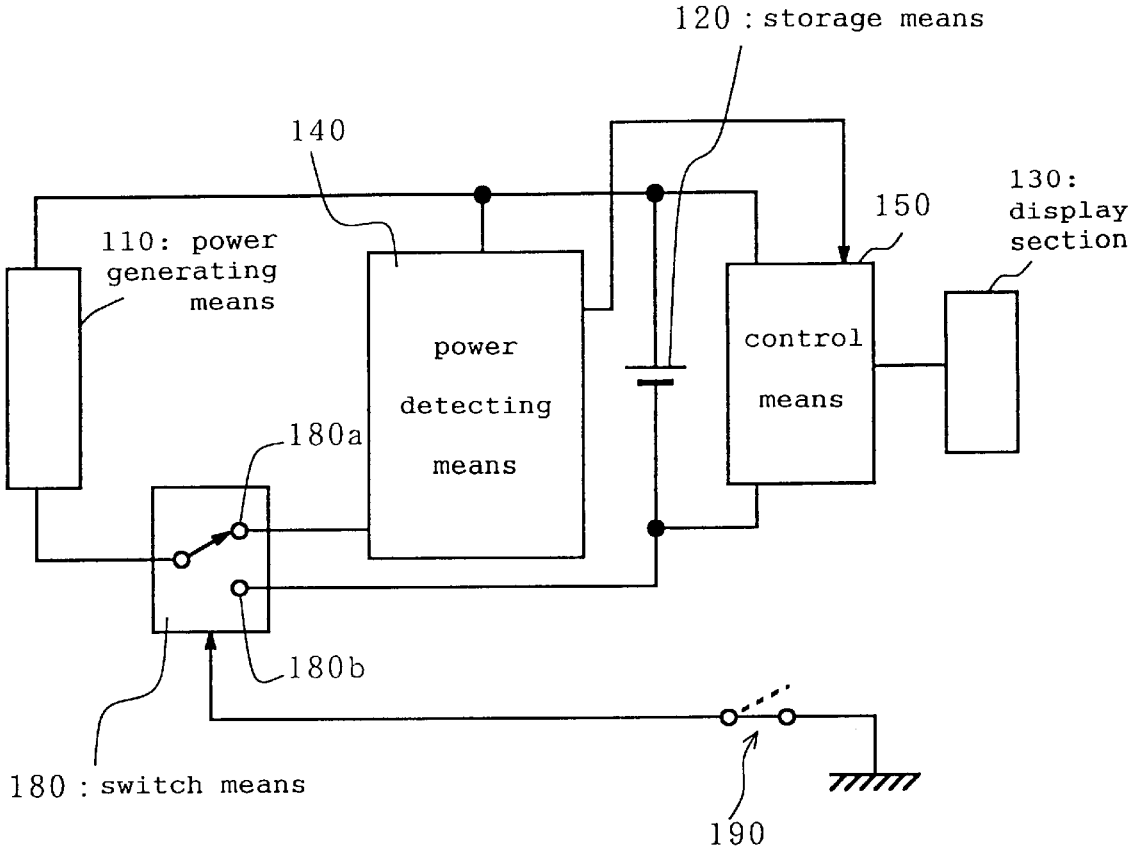
FIG. 6 is a circuit block diagram showing an electronic timepiece according to a second embodiment of the present invention.

FIG. 6 is a circuit block diagram showing an electronic timepiece according to a second embodiment of the present invention.

FIG. 6, the same portions and the same members as those in the block diagram of FIG. 1(*a*) have the same reference numerals and their detailed description will be omitted.

In the present embodiment, an external switch 190 having one of terminals grounded is provided in place of the timing signal A output from the control means 150 shown in FIG. 1(*a*).

When the user of the electronic timepiece operates the switch 190 provided on the outside of the electronic timepiece to turn on the switch 190, the switch in the switch means 180 is changed into a terminal 180*a* and the same detection state as in FIG. 1(*a*) is obtained. When the switch 190 is turned off, the switch in the switch means 180 is changed into a terminal 180*b* to bring a non-detection state.

Figure 7:
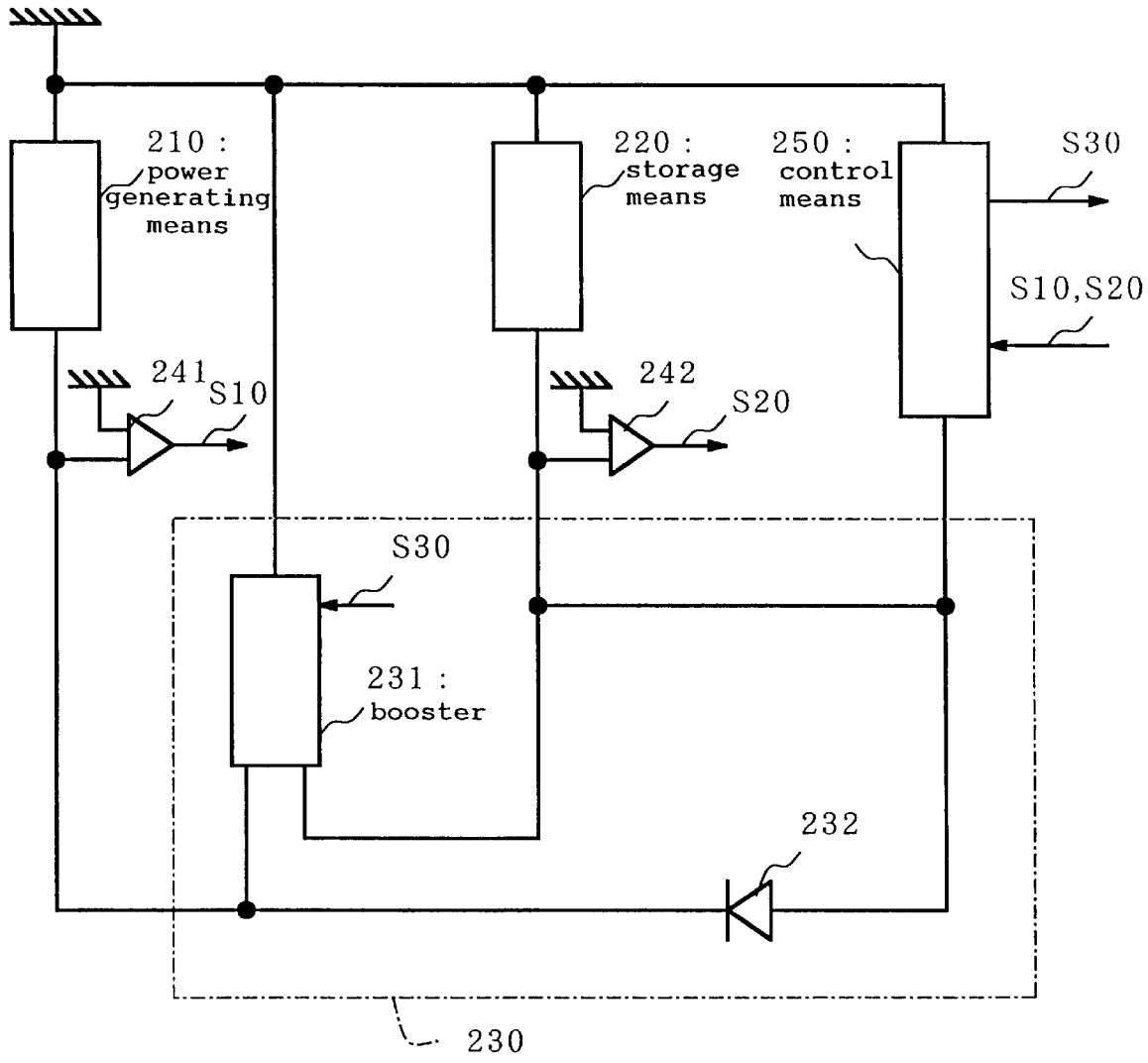
FIG. 7 is a circuit block diagram showing an electronic timepiece according to a third embodiment of the present invention.

FIG. 7 is a circuit block diagram showing an electronic timepiece according to a third embodiment of the present invention.

The electronic timepiece according to the present embodiment comprises power detecting means 241 for detecting a difference in an electric potential between both terminals of power generating means 210 and storage detecting means 242 for detecting a difference in an electric potential between both terminals of the storage means 220. The power detecting means 241 and the storage detecting means 242 can use the same power detecting means 140 as described in the first embodiment.

Since the operation for working the electronic timepiece is the same as the operation described in the first embodiment shown in FIG. 1(*a*), detailed description will be omitted.

When the power generating means 210 is set in a power generating state, the power detecting means 241 outputs a signal to control means 250. The control means 250 which receives this signal outputs a command signal to the display section 230 and moves a second hand more quickly than the modulated hand motion shown in FIGS. 2 to 5(*b*) or a temporarily ordinary one-second hand motion. Consequently, the power generating state is displayed. In the case of an electronic timepiece having the power generating means for generating power by temperature difference power generation, it is possible to notify the power generating state by performing a one-second hand movement only when the electronic timepiece is worn to an arm as shown in FIGS. 5(*a*) and 5(*b*).

Figure 8:
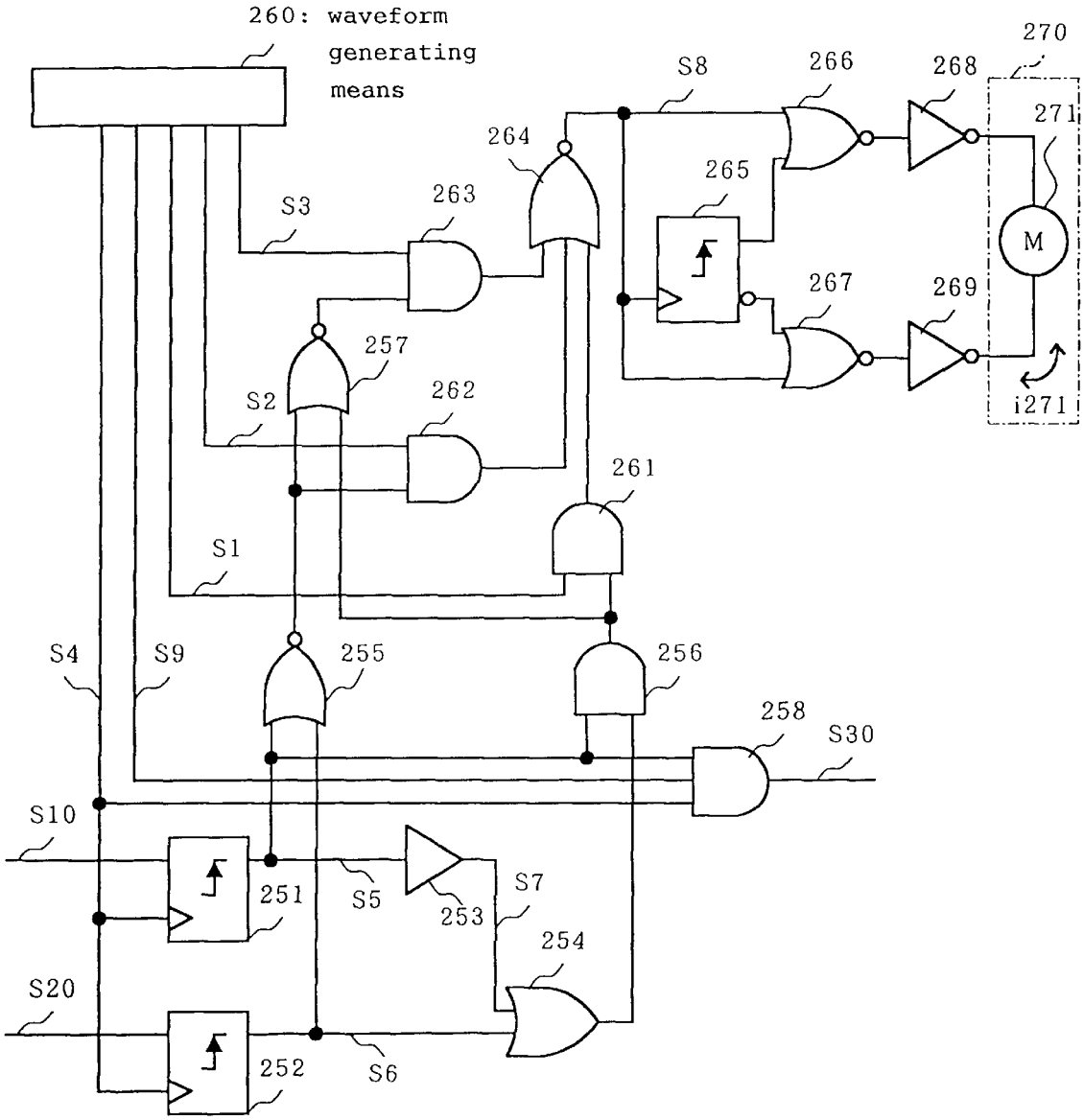
FIG. 8 is a diagram showing the structure of a circuit of control means according to the third embodiment.
Figure 9:
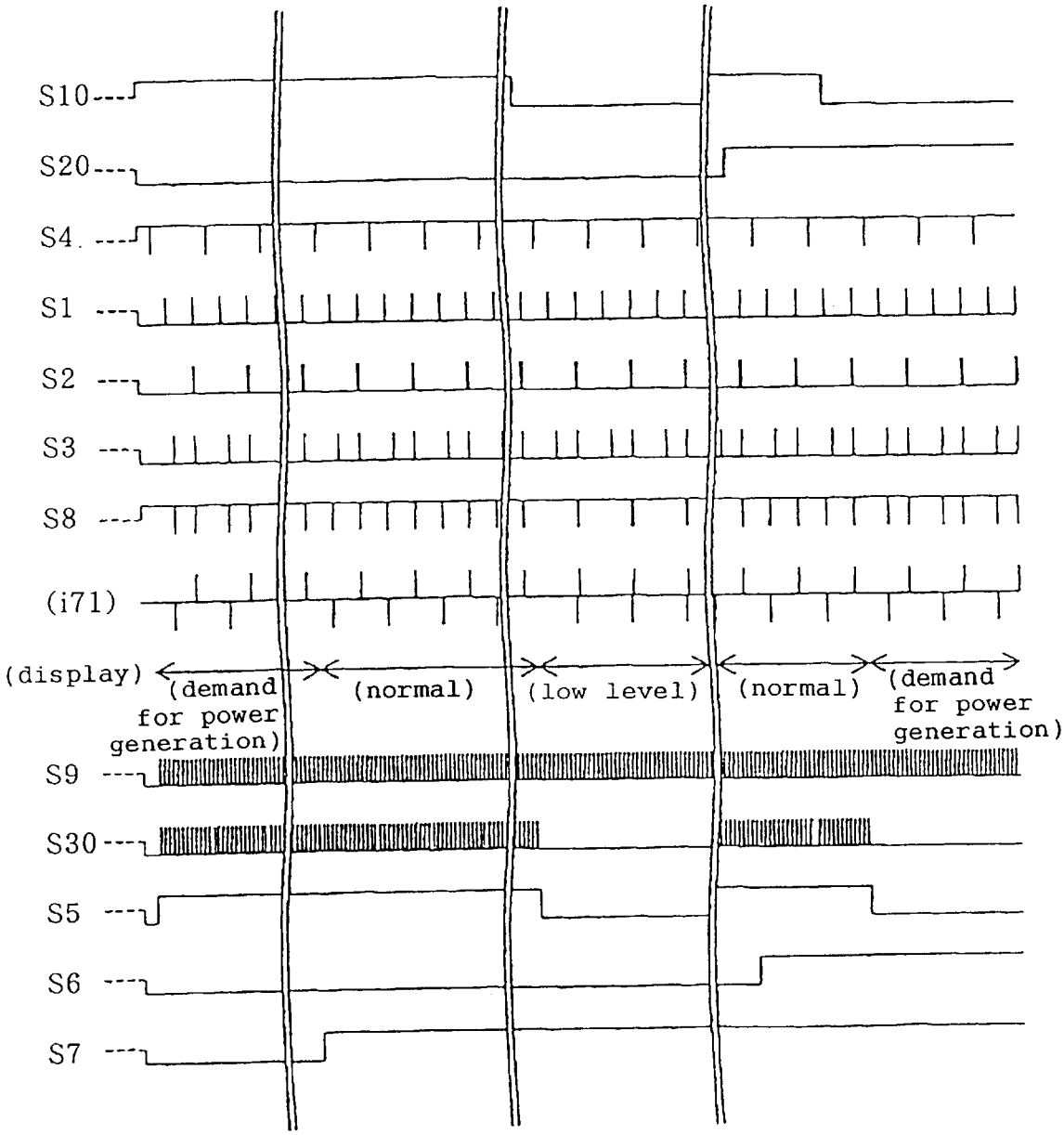
FIG. 9 is a timing chart showing the timing of the output of each signal.

The structure of the electronic timepiece according to the third embodiment will be described in more detail with reference to FIGS. 7 to 9. FIG. 8 is a diagram showing the circuit structure of the control means, and FIG. 9 is a timing chart showing the output timing of each signal.

According the present embodiment, the power generating means 210 is a thermoelectric generator (thermoelectric element block) for generating power by a thermal energy supplied from the outside. The power generator uses a thermoelectric element for generating power depending on a difference in a temperature. Moreover, the thermoelectric element has a plurality of thermocouples arranged in series, which is not shown, and causes the warm junction side of the thermoelectric element to come in contact with the case back of the electronic timepiece, thereby causing the cold junction side to come in contact with a case thermally isolated from the case back. When the electronic timepiece is to be used, the timepiece is operated by power obtained by a difference in a temperature between the case and the case back.

The power generating means 210 having the above-mentioned structure can generate a voltage of approximately 1.0 V between the terminals of the power generating means 210 with a temperature difference of 1° C. made between the warm junction side and the cold junction side.

For a switching element to prevent a current from reversibly flowing into the power generating means 210, a diode 232 is provided between the power generating means 210 and the control means 250. The diode 232 has a cathode connected to a signal line on the power generating means 210 side, and an anode connected to a signal line on the control means 250 side.

Furthermore, the electronic timepiece according to the present embodiment has booster 231. The booster 231 has a boosting circuit for boosting the power generation voltage of the power generating means 210 and outputs the voltage to the storage means 220 and the control means 250. The booster 231 has an input side connected to the negative electrode of the power generating means 210, and an output side connected to the negative electrode of the storage means 220. The booster 231 according to the present embodiment can convert an input voltage double by a combination of two capacitors.

The booster 231 acquires an boosting signal S30 from the control means 250. The boosting signal S30 is generated by the synthesis of waveforms in the control means 250. The waveform serves to cause the booster 231 to perform an boosting operation synchronously with the boosting signal S30 in active state.

The storage means 220 which is a lithium ion secondary battery stores power generated by the power generating means 210. The storage means 220 is provided in order to cause the control means 250 to be operable also when the power generating means 210 does not generate power.

The storage means 220 has a negative electrode connected to the output side of the booster 231 and a positive electrode grounded. The storage means 220 according to the present embodiment is set such that the absolute value of a difference in an electric potential between terminals does not exceed 1.3 V even if the charging is promoted for the simplification of description.

The electronic timepiece according to the present embodiment comprises power detecting means 241 for detecting the power generating state of the power generating means 210 and storage detecting means 242 for detecting the-storage state of the storage means 220. Both of the detecting means 241 and 242 have amplifier circuits.

The amplifier circuit of the power detecting means 241 outputs a high level when the input voltage exceeds 0.65 V, and otherwise outputs a low level. The negative electrode of the power generating means 210 is connected to the input side of the amplifier circuit and the control means 250 is connected to the output side of the amplifier circuit.

The amplifier circuit of the storage detecting means 242 outputs a high level when the input voltage exceeds 1.2 V, and otherwise outputs a low level. The negative electrode of the storage means 220 is connected to the input side of the amplifier circuit and the control means 250 is connected to the output side of the amplifier circuit.

The control means 250 includes waveform generating means 260 for generating a driving waveform for driving a stepping motor 271 and time display means 270 having a train wheel, a hand and the like as shown in FIG. 8. The waveform generating means 260 is used for a general electronic timepiece and serves to divide the oscillating signal of a quartz oscillator to generate a driving waveform.

The control means 250 and the booster 231 described above use an integrated circuit of a complementary type field effect transistor (CMOS) in the same manner as in the general electronic timepiece, which are not shown, and are operated with the same power source.

The positive electrode of the power generating means 210 and that of the control means 250 are grounded, and the power generating means 210, the diode 232 and the control means 250 constitute a closed loop.

The control means 250 has a first latch 251, a second latch 252, a delay buffer 253, a first OR gate 254, a first NOR gate 255, a first AND gate 256, a second NOR gate 257, a second AND gate 258, a third AND gate 261, a fourth AND gate 262, a fifth AND gate 263, a third NOR gate 264, a toggle flip-flop 265, a fourth NOR gate 266, a fifth NOR gate 267, a first driver 268 and a driver 269 as well as the waveform generating means 260 and the time display means 270. Each of these logical circuit gates has two inputs if it is not specified.

The waveform generating means 260 divides the oscillating frequency of the crystal quartz up to a frequency at which a period reaches at least two seconds in the same manner as in a general electronic timepiece. Furthermore, the waveform generating means 260 converts a divided signal (a division signal) into a waveform necessary for the driving of the stepping motor 271 in the time display means 270.

Moreover, the time display means 270 has the above-mentioned stepping motor 271, a decelerating train wheel which is not shown, and a hand and a dial for time display. The rotation of the stepping motor 271 is decelerated by the decelerating train wheel. Consequently, the time is displayed by moving the hand for the time display.

Since the waveform generating means 260 and the time display means 270 are the same as in the general electronic timepiece, detailed description will be omitted.

The waveform generating means 260 outputs a first display signal S1, a second display signal S2, a third display signal S3, a detection clock S4 and an boosting clock S9.

The first display signal S1, the second display signal S2 and the third display signal S3 are originals for rotating and driving the stepping motor 271 of the time display means 270 described above. These have waveforms in which a time for the high level is 5 milliseconds.

A cycle for the high level includes a predetermined cycle in which the first display signal S1 is set to one second, a cycle in which the second display signal S2 is alternately changed to 65 milliseconds and 1935 milliseconds, and a cycle in which the third display signal S3 is alternately changed to 375 milliseconds and 625 milliseconds as shown in FIG. 9.

Moreover, the detection clock S4 is a waveform in which a time for the low level is eight milliseconds and a cycle thereof is two seconds. Furthermore, the boosting clock S9 is a rectangular waveform having a frequency of 4 KHz.

Since these waveforms can be generated by a known waveform synthesizing method as described above, the generating method will be omitted.

The first latch 251 and the second latch 252 are data latches in which an output is reset when a power source is turned on. The detecting signal S4 is transmitted to the first latch 251 and the second latch 252, and a data input signal can be held or output at the rising edge of the waveform of the detection clock S4.

Moreover, a power generation detecting signal S10 which is the output of the power detecting means 241 of the power generating means 210 is input to the data input side of the first latch 251. Then, a first latch signal S5 is output from the output side of the first latch 251.

A storage detecting signal S20 which is the output of the storage detecting means 241 is input to the data input side of the second latch 252. Then, a second latch signal S6 is output from the output side of the second latch 251.

The first latch signal S5 is transmitted to the delay buffer 253. The delay buffer 253 is a delay circuit for delaying an input waveform by 10 seconds and outputting the delayed waveform.

The output of the delay buffer 253 is input as a delay signal S7 to one of the input sides of the first OR gate 254. Furthermore, the second latch signal S6 is transmitted to the other input side of the first OR gate 254.

The first latch signal S5 and the second latch signal S6 are also transmitted to the first NOR gate 255. The first NOR gate 255 can output a NOR signal. first NOR gate 255 can output an NOR signal.

On the other hand, the first latch signal S5 and the output signal of the first OR gate 254 are transmitted to the first AND gate 256, and these ANDs are output from the first AND gate 256.

Furthermore, the output signal of the first NOR gate 255 and that of the first AND gate 256 are transmitted to the second NOR gate 257, and these NOR signals are output from the second NOR gate 257.

The first display signal S1 and the output signal of the first AND gate 256 are transmitted to the third AND gate 261 and these ANDs are output from the third AND gate 261.

The second display signal S2 and the output signal of the first NOR gate 255 are transmitted to the fourth AND gate 262 and these ANDs are output from the fourth AND gate 262.

Furthermore, the third display signal S3 and the output signal of the second NOR gate 257 are transmitted to the fifth AND gate 263 and these ANDs are output from the fifth AND gate 263.

The third NOR gate 264 to be a three-input NOR gate outputs, as a selection display signal S8, a NOR signal of each of the output signals of the third AND gate 261, the fourth AND gate 262 and the fifth AND gate 263.

On the other hand, the selection display signal S8 is input to the toggle flip-flop 265. The toggle flip-flop 265 is a flop-flop of a toggle type in which a holding signal and an output signal are inverted every time when an input signal rises. For simplification of description, in the toggle flip-flop 265, hold data are reset when the power source is turned on.

The output signal of the toggle flip-flop 265 and the selection display signal S8 are transmitted to the fourth NOR gate 266, and these NOR signals are output from the fourth NOR gate 266.

Moreover, the negative side output signal of the toggle flip-flop 265 and the selection display signal S8 are transmitted to the fifth NOR gate 267, and these NOR signals are output from the fifth NOR gate 267.

The output signal of the fourth NOR gate 266 is transmitted to the first driver 268 and the output signal of the fifth NOR gate 267 is transmitted to the second driver 269.

The output signal of the first driver 268 and that of the second driver 269 are transmitted to the stepping motor 271 in the time display means 70.

The first driver 268 and the second driver 269 are 1-input inverters having a very low output impedance. One of input of the first driver 268 or the second driver 269 has a high level and the other input has a low level. Consequently, a current flowing in an optional direction can be supplied to the stepping motor 271 connected to the output side of each of the first driver 268 and the second driver 269.

Furthermore, the first latch signal S5, the detection clock S4 and the boosting clock S9 are transmitted to the second AND gate 258 to be a three-input AND gate. The output of the second AND gate 258 is transmitted as a boosting signal S30 to the control means 230 for charging and discharging.

The electronic timepiece according to the present embodiment is constituted as described above.

With reference to FIGS. 7 to 9, the operation of the electronic timepiece according to the third embodiment will be described.

In the following description, a state in which less power is stored in the storage means 220, a difference in an electric potential between terminals is approximately 0.9 V and the state where the operation of the control means 250 is stopped is defined as an initial state.

If the difference in an electric potential between the terminals of the storage means 220 is 1.0 V or more, the operation of the electronic timepiece of the present embodiment can be started. First of all, the starting operation will be described.

In an environment in which the power generating means 210 starts power generation from the above-mentioned initial state and a power generation voltage of approximately 1.0 V is generated, the diode 232 is turned on. By the power generated by the power generating means 210, the power is supplied to the storage means 220 and the control means 250. Then, when a storage voltage is raised to a level at which the starting can be performed, the control means 220 starts a predetermined operation.

In the present embodiment, when a difference in a temperature occurs in the timepiece, for example, the electronic timepiece is worn to the arm, a power is generated by power generation.

When the control means 250 starts to be operated, the waveform generating means 260 in the control means 250 starts to output the first to third display signals S1 to S3, the detection clock S4 and the boosting clock S9.

Moreover, immediately after the operation of the control means 250 is started, the first latch 251 and the second latch 252 are initialized into the output having the low level. Accordingly, the output of the first NOR gate 255 is set to the high level and the output of the first AND gate 256 is set to the low level.

As a result, the fourth AND gate 262 exactly outputs the second display signal S2, and the outputs of the third AND gate 261 and the fifth AND gate 263 are kept at the low level. Accordingly, NOT signal of the second display signal S2 appears on the selection display signal S8 to be the output of the third NOR gate 264.

Immediately thereafter, the detection clock signal S4 falls. In practice, therefore, the operation to be performed after the start of the power generation which will be described below is immediately initiated.

When a pulse having the low level appears on the detection clock S4, the first latch 251 and the second latch 252 fetch the outputs signals of the power detecting means 241 and the storage detecting means 242 in a rise timing.

At this time, the storage voltage is low and the power generation voltage is high. Therefore, the first latch signal S5 is changed into the high level, and the second latch signal S6 keeps the low level.

On the other hand, the boosting signal S30 to be the output of the second AND gate 258 becomes active to output the same waveform as the boosting clock S9 provided that the detection clock S4 does not have the low level and the first latch signal S5 outputs the high level.

Consequently, when the detection clock is set to the low level, the booster 231 is stopped. Thus, a correct power generation voltage and a correct storage voltage can be applied to the inputs of the power detecting means 241 and the storage detecting means 242, and the booster 231 is caused to operate conversion only when the power generation of the power generating means 210 is detected.

When the detection clock S4 rises and the first latch signal S5 is set to the high level, the boosting signal S30 becomes active. As a result, the storage means 220 is charged by the boosting operation of the booster 231.

Even if the first latch signal S5 is changed to the high level, the output of the delay buffer 253 is kept at the low level. Therefore, the first AND gate 256 is kept at the low level and the output of the first AND gate 256 is kept at the low level.

Furthermore, when the first latch signal S5 is set to the high level, the output of the first NOR gate 255 is changed to the low level and that of the fourth AND gate 262 is changed to the low level.

To the contrary, the output of the second NOR gate 257 is changed to the high level. Therefore, the fifth AND gate 263 exactly outputs the third display signal S3. As a result, NOT signal of the third display signal S3 appears on the selection display signal S8.

The toggle flip-flow 265 inverts an outputs every time when a pulse having the low level is input. Therefore, NOT signals of the third display signal S3 are input as the selection display signal S8. Consequently, a pulse having the high level of the third display signal S3 is alternately output by the fourth NOR gate 266 and the fifth NOR gate 267.

As a result, the first driver 268 and the second driver 269 can cause a current alternately switching a direction to flow to the stepping motor 271 synchronously with the pulse having the high level of the third display signal S3.

In FIG. 8, the current conducted to the stepping motor 271 is indicated as reference number i271.

The time display means 270 performs the motion of a hand for the time display in response to the third display signal S3. The third display signal S3 is a hand motion signal which slightly gets out of a one-second cycle. At this time, therefore, the hand motion looks different from usual. Consequently, it is possible to display that the power generation is started but a power generation period is not sufficient (a demand for power generation).

The hand motion will be hereinafter referred to as an "irregular one-second hand motion".

When the power generation is continuously carried out for ten seconds (a delay time for the delay buffer 253), the first latch signal S5 is set to the high level. Therefore, the delay signal S7 is also changed to the high level.

When the delay signal S7 is set to the high level, the first OR gate 254 outputs the high level, and furthermore, the output of the first AND gate 256 is also set to the high level.

Moreover, the output of the second NOR gate 257 is changed to the low level. As a result, NOT signal of the first display signal S1 appears on the selection display signal S8.

Consequently, a current flows to the stepping motor 271 in the time display means 270 in response to the first display signal S1, and the time display operation is carried out by the (ordinary) one-second hand motion to be just one-second cycle.

Next, description will be given to an operation to be carried out when the storage means 220 is not sufficiently charged.

When the power generation voltage of the power generating means 210 is set to 0.65 V or less before the absolute value of the difference in an electric potential between the terminals of the storage means 220 does not reach 1.2 V, the first latch signal S5 is set to the low level with a rise in the pulse having the low level of the detection clock S4 and the second latch signal S6 continuously has the low level.

At this time, the first NOR gate 255 is output at the high level and the output of the first AND gate 256 is set to the low level. Therefore, the output of the third AND gate 261 is changed to the low level and the second display signal S2 is exactly output from the fourth AND gate 262.

Accordingly, the selection display signal S8 is NOT signal of the second display signal S2. As a result, the time display means 270 performs the motion of the time display hand in response to the second display signal S2.

In response to the second display signal S2, the time display means 270 can be moved by a so-called two-second hand motion (a hand motion for two steps at a small interval having a two-second cycle). Consequently, it is possible to indicate that there is less residual storage level and charging is not carried out by the power generation.

At this time, the first latch signal S5 is set to the low level. Therefore, the boosting signal S30 is changed into the low level and the booster 231 stops the boosting and charging operation as described above.

Next, description will be given to an operation to be carried out when the storage means 220 is sufficiently changed.

When the power generating means 210 continuously generates power for 10 seconds or more to consecutively boosting charge the storage means 20, the absolute value of the difference in an electric potential between the terminals of the storage means 220 exceeds 1.2 V soon.

At this time, the second latch signal S6 is changed to the high level at a rise in the pulse having the low level of the detection clock S4.

The first latch signal S5 keeps the high level while the power generation of the power generating means 220 is carried out. The output of the first NOR gate 255 has the low level and that of the first OR gate 254 has the high level. For this reason, the time display means 270 continues the one-second hand motion as described above.

Next, description will be given to an operation to be carried out when the power generation is stopped in the state in which the charging progresses.

As described above, the storage means 220 is sufficiently charged by the power generation of the power generating means 210. Consequently, when the absolute value of the difference in an electric potential between the terminals of the storage means 220 exceeds 1.2 V and the power generation of the power generating means is then stopped, the detection clock S4 rises to the pulse having the low level and the first latch signal S5 is changed to the low level.

Since the absolute value of the difference in an electric potential between the terminals of the storage means 220 exceeds 1.2 V, the second latch signal S6 keeps the high level.

Consequently, the output of the first NOR gate 255 is kept at the low level, while the output of the first AND gate 256 is changed to the low level. Thus, the output of the second NOR gate 257 is set to the high level.

Moreover, the output of the third AND gate 261 is also changed to the low level.

Accordingly, the third display signal S3 is exactly output from the fifth AND gate 263. As a result, the time display means 270 performs a hand motion which slightly gets out of the one-second cycle in response to the third display signal S3. This indicates the state of a demand for power generation as described above.

As is apparent from the above description, in the electronic timepiece according to the present invention, the two-second hand motion is carried out when the power generating means does not generate power and the residual storage level is also very low. If the power generating means 220 starts the power generation when the residual storage level of the storage means 220 is very low, the ordinary one-second hand motion is carried out after the irregular one-second hand motion is performed for first ten seconds. When the residual storage level of the storage means 220 is sufficient and the power generating means 210 is generating power, the one-second hand motion is always carried out. When the residual storage level of the storage means 220 is sufficient and the power generating means 210 does not generate power, the irregular one-second hand motion is carried out.

In the present embodiment, the description has been given by taking, as an example, the power generating means including the thermoelectric element having the thermocouples provided in series. However, it is also possible to use a mechanical power generator using other power generating means, for example, a solar cell or a oscillating weight, and the like.

While the power detecting means has simply compared a power generation voltage with a predetermined threshold, it is possible to detect the generated power level by other methods based on the power generating characteristics of the power generating means.

In particular, the above-mentioned solar cell serves as a power generator in which the level of a current capable of being supplied is greatly changed depending on the irradiation level of light. Therefore, a current may be caused to flow from a solar cell to a load such as a resistive element during the detection, thereby detecting the level of power generation may be detected based on a drop in a voltage generated on the load.

While a delay circuit such as the delay buffer 253 has been used to have a predetermined time (10 seconds in the above-mentioned embodiment) until the ordinary hand motion is switched such that the hand motion is not rapidly switched after the power generation of the power generating means 10 is started in the above-mentioned embodiment, such delay means may not be always provided.

To the contrary, it is apparent that a similar circuit structure can implement that the hand motion is not rapidly switched when the power generating means 210 stops the power generation. This is effective in the use of the power generating means for intermittently generating power such as the above-mentioned mechanical power generator having an oscillating weight.

Moreover, when the storage means 220 is overcharged beyond a rating storage voltage and the power generating means 210 continues the power generation, it is also possible to add another mode of the hand motion mode to notify the overcharging.

While the charge and discharge control means 250 has been constituted by only the diode 232 and the booster 231 in order to simplify the structure in the above-mentioned embodiment, a switch for electrically connecting or cutting off the storage means 220, the control means 250 and the booster 231 according to the power generating state and the storage state may be properly provided in the same manner as in a general charging type electronic timepiece.

Furthermore, although the booster 231 is also a simple double boosting circuit, the booster 231 may be replaced with a simple charging switch if the power generation voltage is sufficiently obtained and up conversion is not necessary.

Conversely, the booster 231 can also be a multistage boosting circuit. In this case, it is preferred that a proper boosting multiplication can be selected according to a power generation voltage and a storage voltage which are changed.

According to the first to third embodiments described above, it is possible to immediately decide, from the display of the display means, whether or not the power generating means generates power. Thus, it is possible to visually confirm that the power generating means surely generates power. Accordingly, a user can carry the electronic timepiece at ease. Moreover, it is possible to obtain an electronic timepiece which emphasizes an interest by knowing the power generating state.

A fourth embodiment of the present invention will be described below.

In the fourth embodiment, an ordinary one-second hand motion is carried out during the power generation of the power generating means and a four-second hand motion is carried out during non-power generation irrespective of the storage level of storage means. When the storage level of the storage means is lower than a predetermined value during the non-power generation, the four-second hand motion is carried out for a predetermined time and a second hand is stopped with a timing mechanism driven. Furthermore, when such a state continues for a predetermined time, all the hands are stopped to perform power saving with the timing mechanism driven. Moreover, the power generation of the power generating means is restarted to quickly move each hand, thereby indicating an accurate present time.

Figure 10:
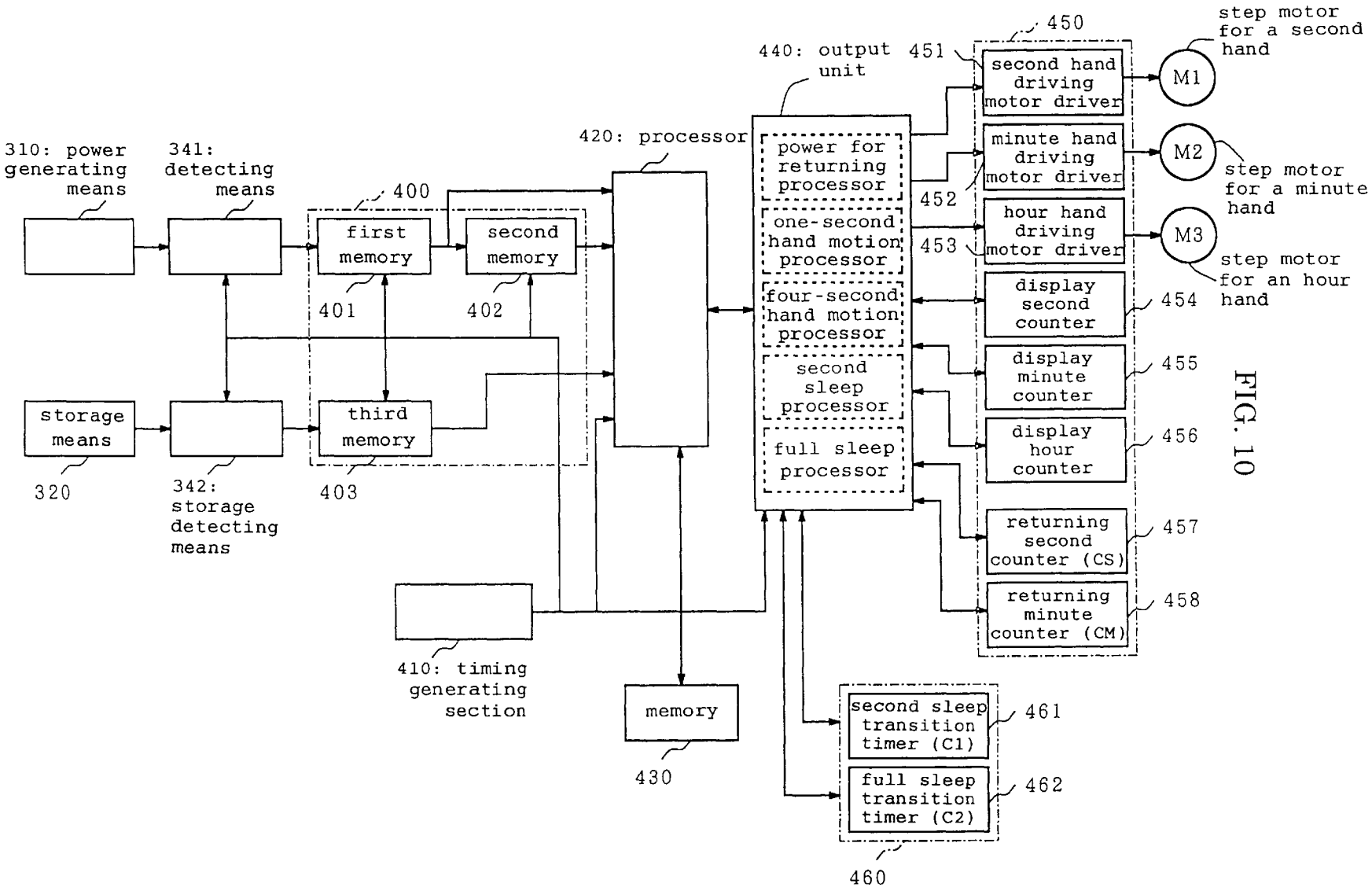
FIG. 10 is a block diagram showing an electronic timepiece having a power save function according to a fourth embodiment of the present invention.

FIG. 10 is a block diagram showing the electronic timepiece according to the present embodiment comprising the above-mentioned power saving function.

In the fourth embodiment, description will be given on the assumption that the electronic timepiece has three step motors for a hand movement, that is, three step motors M1 for a second hand, M2 for a minute hand and M3 for an hour hand. In the case where two step motors, that is, one for the second and minute hands and the other for the hour hand are provided, the present invention can be applied.

The electronic timepiece of the present embodiment comprises power detecting means 341 for detecting the power generating state of power generating means 310, storage detecting means 342 for detecting the storage state of storage means, a storing means 400 for storing a state detected by each of the detecting means 341 and 342, a timing generating section 410 for generating a detection timing, a processor 420 for performing control such as a modulated hand motion in a timing generated by the timing generating section 410, a memory 430 for storing a hand motion mode for each detection timing, an output unit 440 for outputting a signal for driving a driving unit 450 in response to a command of the processor 420, a timer section 460 for measuring a time for a transition to a second sleep or a full sleep, and a returning second counter 457 and a returning minute counter 458 for counting a stop time during the second sleep or the full sleep in the detection timing.

The storing means 400 has a first memory 401 for storing the power generating state detected by the power detecting means 341, a second memory 402 for storing the power generating state in a last detection timing, and a third memory 403 for storing the storage state detected by the storage detecting means 342.

Moreover, the timer 460 has a second sleep transition timer 461 for measuring a time for a transition to the second sleep state and a full sleep transition timer 462 for measuring a time for a transition to the full sleep in which all the hands are stopped.

The detection of the power generating state and the storage state is carried out in a predetermined timing. The detection of the power generating state and the storage state can be carried out by detecting a difference in an electric potential of both terminals of the power generating means 310 and the storage means 320 as described in the above-mentioned embodiments.

Figure 11:
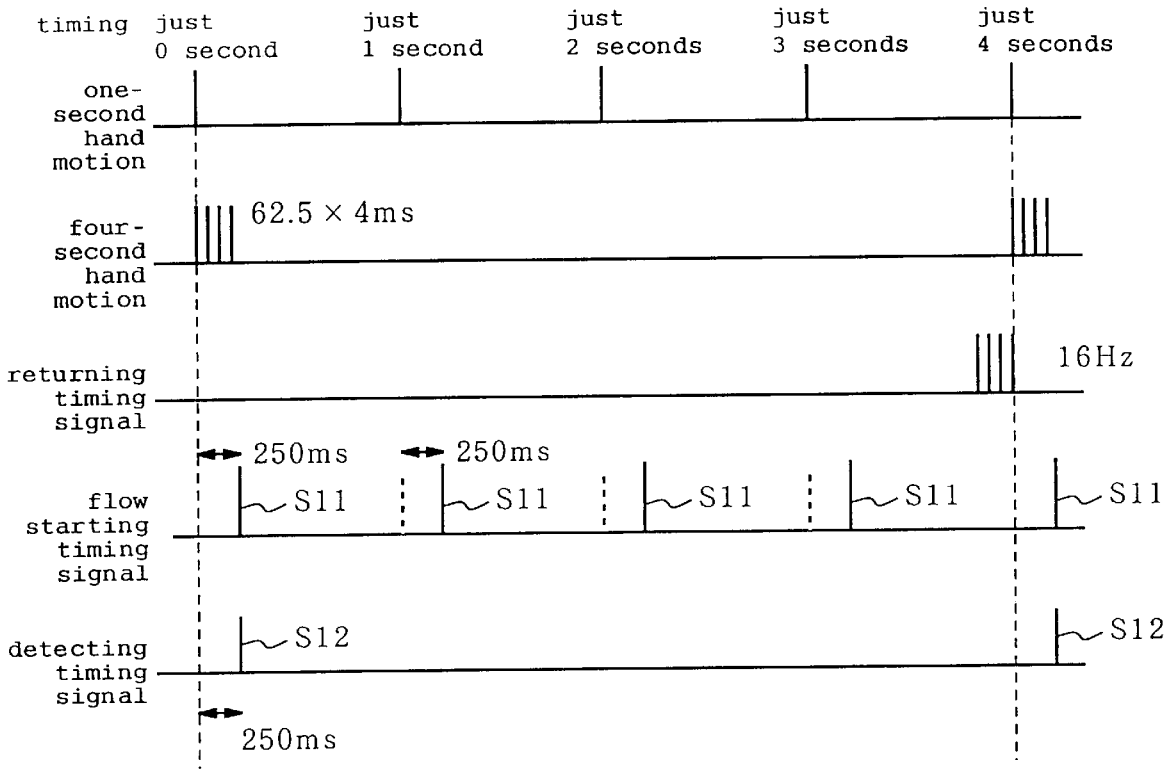
FIG. 11 is a timing chart showing the output of a signal for a detection timing and the output of a timing signal for a hand motion according to the fourth embodiment of the present invention.

The timing generating section 410 generates a flow start timing signal S1 at an interval of one second and generates a detection timing signal S2 at an interval of four seconds as shown in FIG. 11, for example. The "flow start timing" indicates a timing for starting a processing according to flowcharts shown in FIGS. 12 to 14 which will be described later in detail. A flow start timing signal S1 is transmitted to the processor 420 and a detection timing signal is transmitted to the power detecting means 341 and the storage detecting means 342. The flow timing signal S1 and the detection timing signal S2 are set to the advance side by 250 ms from just 0 second (a reference position for starting the motion of a second hand is represented as a prefix of "just"), just one second, just two seconds. . . .

When the power detecting means 341 and the storage detecting means 342 receive the detection timing signal S2, the power detecting means 341 detects the power generating state of the power generating means 310 and the storage detecting means 342 detects the storage state of the storage means 320. The power generating state and the storage state which are detected are stored in the first memory 401 and the third memory 403.

When all the processing of the one-time detection timing are ended, the memory contents are transferred from the first memory 401 to the second memory 402, and are stored in the second memory 402.

The driving unit 450 includes a second hand driving motor driver 451 for driving a motor M1 for driving the second hand, a minute hand driving motor driver 452 for driving a motor M2 for driving the minute and second hands, an hour hand driving motor driver 453 for driving an hour hand driving motor M3, a display second counter 454 for holding a value corresponding to the actual position of the second hand, a display minute counter 455 for holding a value corresponding to the actual position of the minute hand, and a display hour counter 456 for holding a value corresponding to the actual position of the hour hand.

The detection timing signal of the timing generating section 410 is also transmitted to the processing position 420. Consequently, a predetermined processing is executed.

Figure 12:
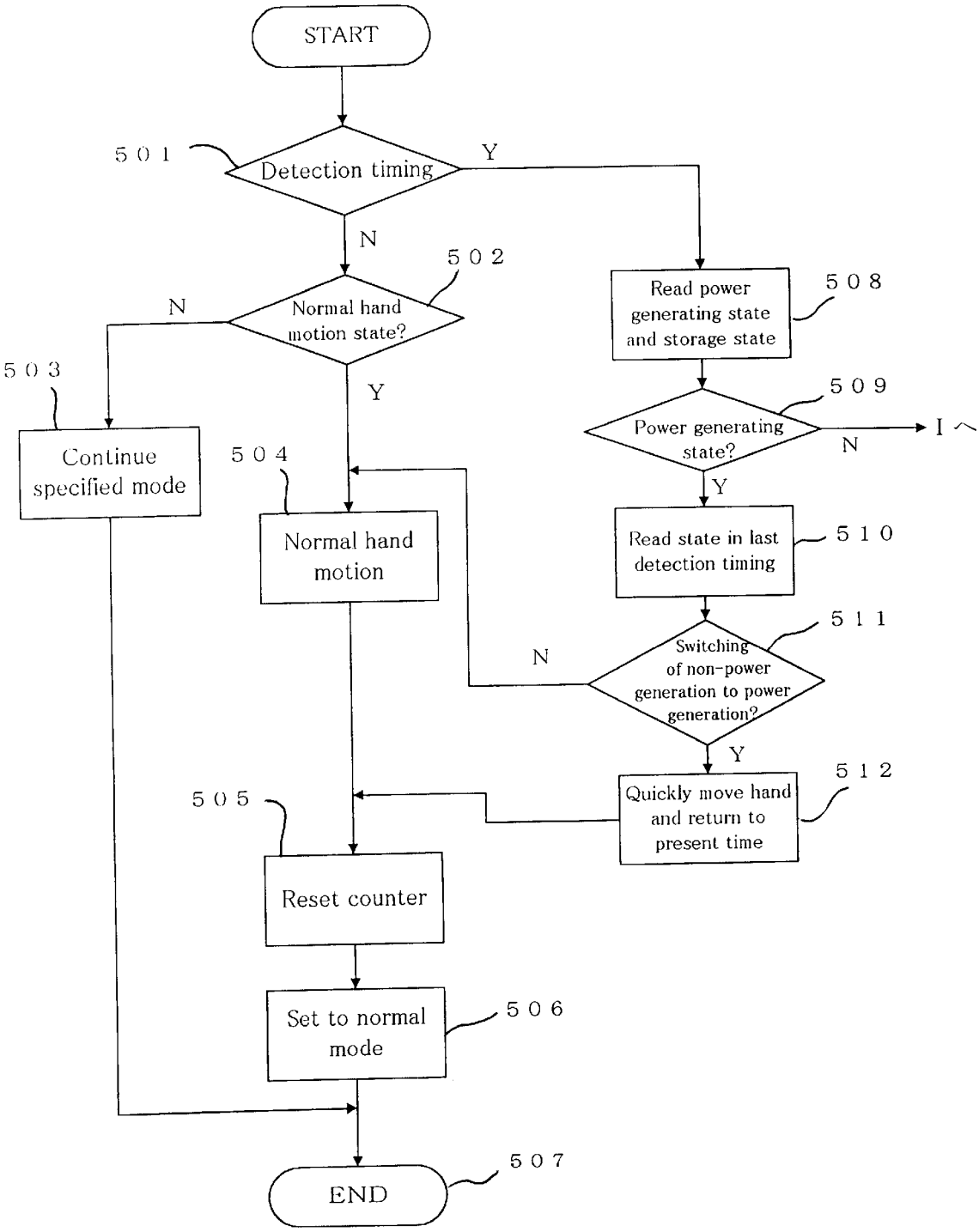
FIG. 12 is a flowchart for explaining the operation of the electronic timepiece according to the fourth embodiment of the present invention.
Figure 13:
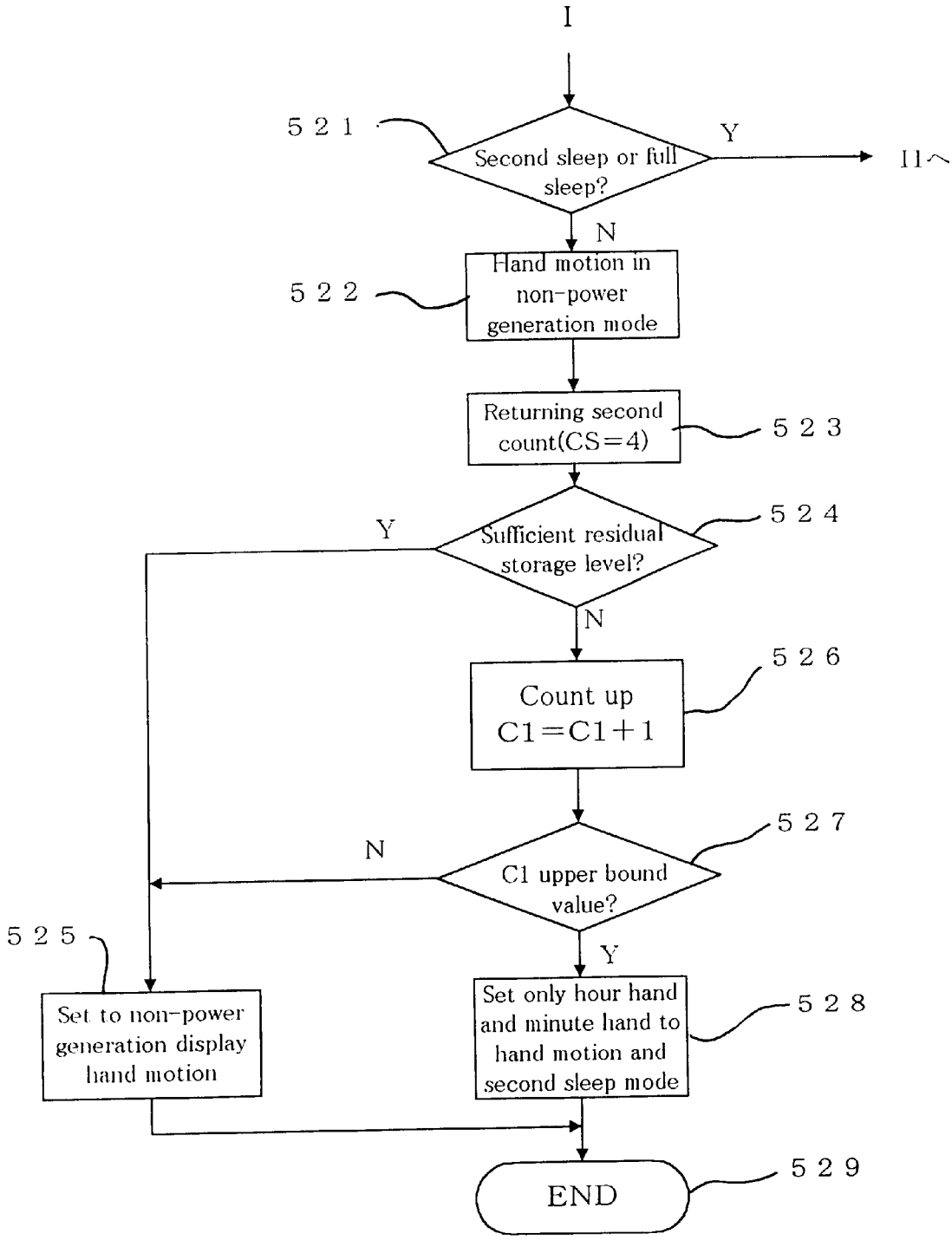
FIG. 13 is a flowchart subsequent to the flowchart shown in FIG. 12.
Figure 14:
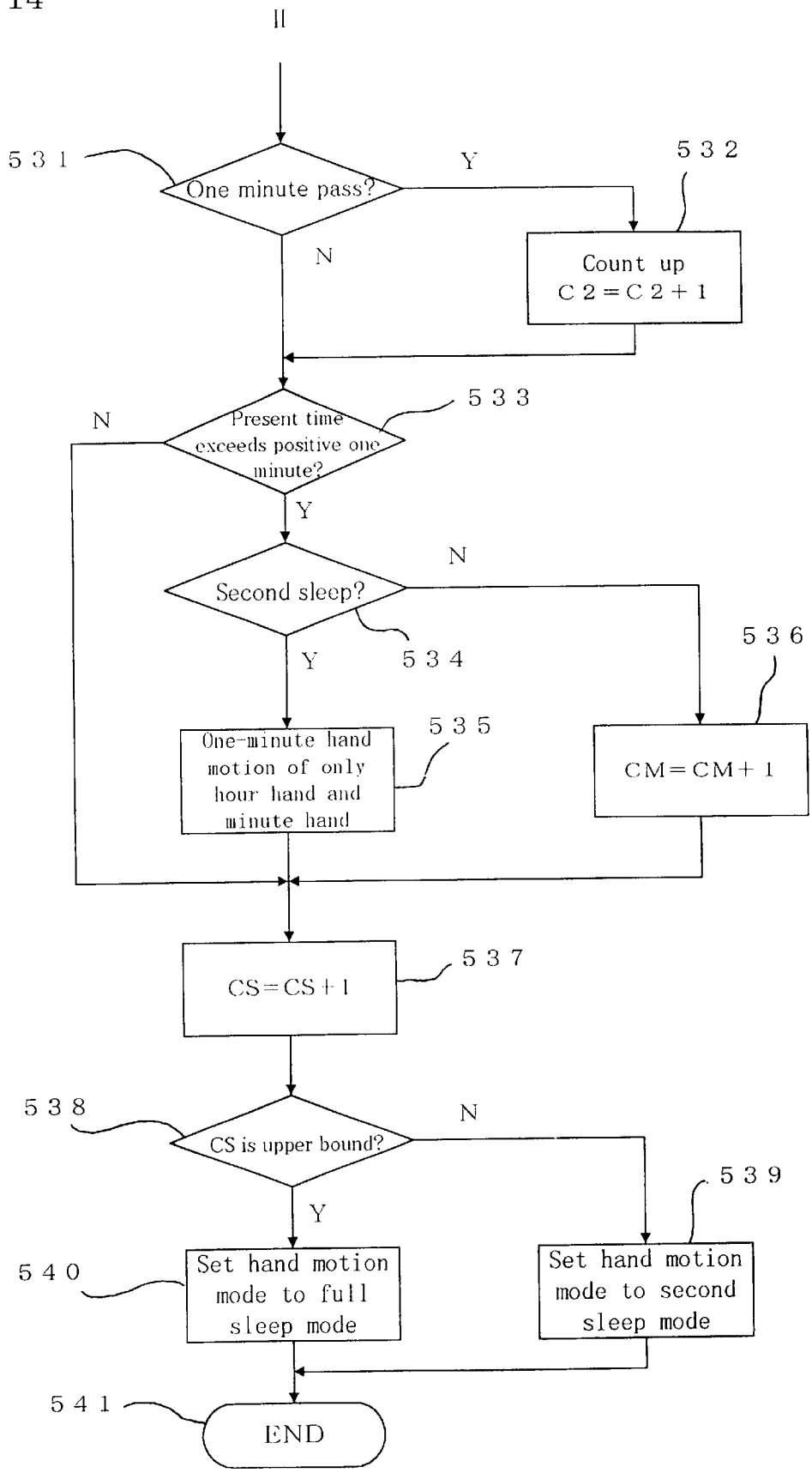
FIG. 14 is a flowchart subsequent to the flowchart shown in FIG. 13.
Figure 15:
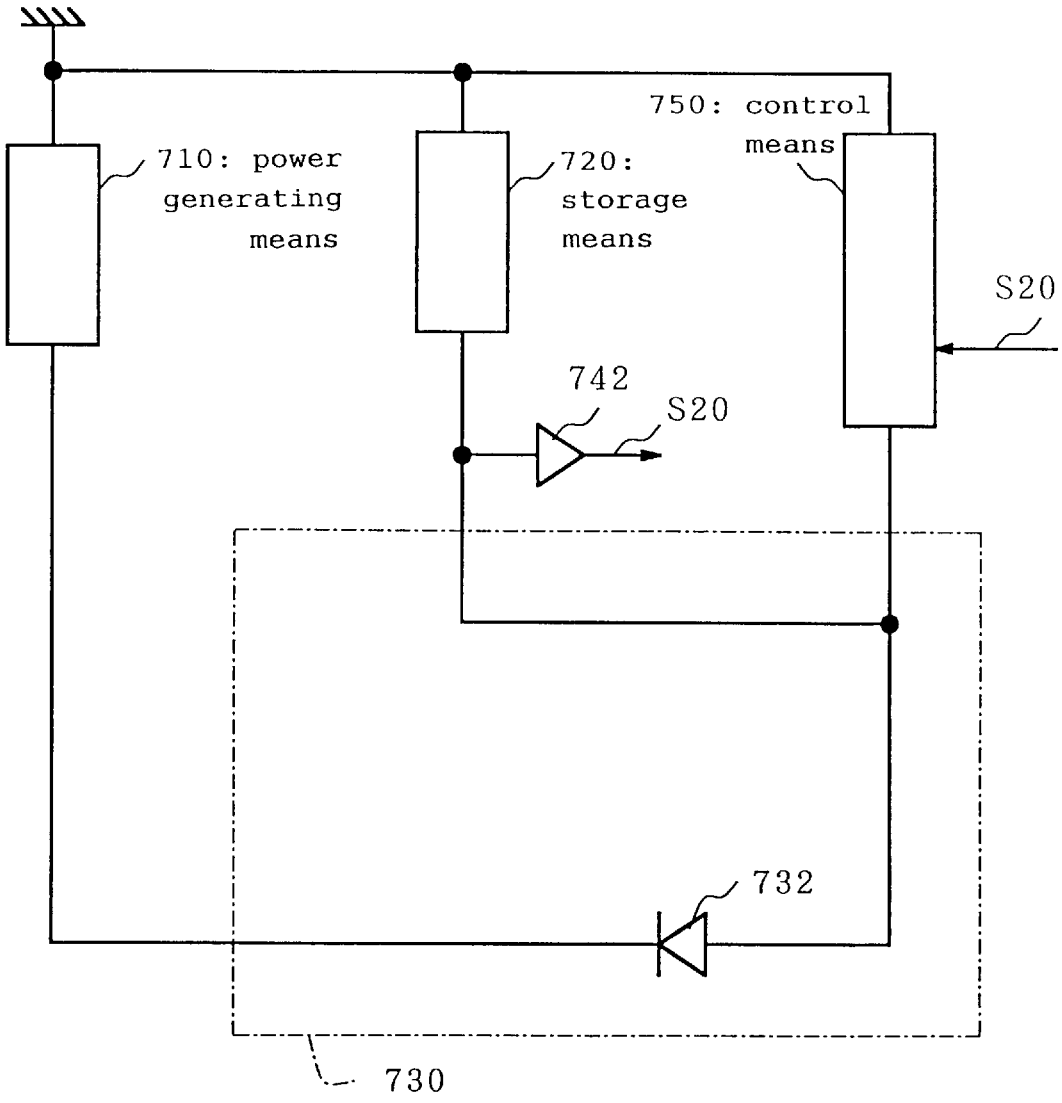
FIG. 15 Prior Art
FIG. 15 is a block diagram illustrating the structure of a circuit of an electronic timepiece having a power generating function according to the prior art.

FIGS. 12 to 14 are flowcharts showing an example of a processing in the processor 420. As described above, the processing according to the flowcharts shown in FIGS. 12 to 14 are carried out at an interval of one second.

The processor 420 executes processing at Steps 502 to 507 simultaneously with the transmission of a flow start timing signal S1 while the detection timing signal S2 is not transmitted in the timing for generating the timing generating section 410. More specifically, the hand motion state is read out from the memory 430 and it is decided whether the hand motion state is normal (an ordinary one-second hand motion) or a modulated hand motion in the timing generating section 410 (Step 502).

If the hand motion state is not normal, a specified mode is continued (Step 503). If the hand motion state is normal, the hand motion is carried out in a normal state (Step 504), a returning second counter (CS) 457, described below, a returning minute counter (CM) 458, a second sleep transition timer (C1) 461 and a full sleep transition timer (C2) 462 which will be described below are reset (CS=0, CM=0, C1=0, C2=0) (Step 505).

When the detection timing signal is input, processings after Step 507 are carried out.

First of all, the power generating state of the power generating means 310 and the storage state of the storage means 320 are read out from the first memory 401 and the third memory 403 (Step 508). Then, it is decided whether or not the power generating means 310 is set in the power generating state (Step 509).

If the power generating state is set during a detection timing, the state at a last detection timing is read out from the second memory 402 (Step 510), and it is decided whether or not switching from the non-power generating state to the power generating state was performed in a past detection timing (Step 510).

When the switching from the non-power generating state to the power generating state was carried out in a past detection timing, the hand is quickly moved before the next detection timing to return to the present time (Step 512).

Then, the routine returns to Step 505 to reset a timer and a counter and to set to a normal mode (Step 506). Thus, a processing is ended (Step 507).

When the power generating means 310 is set in the non-power generating state, it is decided, from the memory 480, whether the state of the hand motion in a last detection timing is a second sleep (a state in which only the second hand is stopped) or a full sleep (a state in which all the hands are stopped) (Step 521).

In the case where the second sleep state or the full sleep state is not set, the hand is moved by a four-second hand motion for non-power generation (Step 522), and the returning second counter (CS) 457 is set to four seconds (CS=4) (Step 523).

Then, the storage state is read out from the third memory 403 to decide whether or not the level (residual level) of storage is sufficient. If the storage level is sufficient, the non-power generating state is displayed to set the hand motion state memory to the four-second hand motion mode (Step 525).

If the residual level is less, the second sleeve transition timer (C1) 461 is advanced by 1 (Step 526). In this case, the detection timing is carried out every four seconds. Therefore, the second sleep transition timer (C1) 461 is advanced for four seconds.

In the case where the residual storage level of the storage means is low and the charging from the power generating means is not carried out for a predetermined time or more, the second sleep transition timer counter (C1) 461 serves to bring the secondhand into a sleep state. If the counter C1 reaches a predetermined upper bound value (Step 527), only the hour hand and the minute hand are moved to be set to a second sleep mode in which the second hand is stopped (Step 528). If the counter C1 does not reach the predetermined upper bound value (Step 527), the four-second hand motion is continued. Thus, the processing is ended (Step 529). The upper bound value of the second sleep transition timer counter (C1) 461 can be properly set based on the relationship between the storage level (the residual level) and the level of consumed power of the electronic timepiece. In order to perform the second sleep after one minute passes since the storage level of the storage means 320 becomes lower than a predetermined value, for example, it is preferable that the upper bound value should be set to 15 (four seconds×15=60 seconds).

In the second sleep or full sleep state, it is decided, from the count number of the returning second counter (CS) 457, whether one minute passes after the hand is stopped. If the returning second counter (CS) 457 for counting a count number in sexagesimal indicates CS=0, it is decided that one minute has passed (Step 531).

If CS=0 is set, the full sleep transition timer (C2) 462 is advanced by one (one minute) (Step 532).

Then, it is decided whether or not the minute hand of the present time exceeds just one minute in a current detection timing (Step 533). For example, in the case where the detection is being carried out every four seconds, the current time (second) in the current detection timing is obtained immediately after the just two seconds if the last detection timing is obtained immediately after just 58 seconds. In this case, therefore, it is decided that just one minute is exceeded.

If it is decided that the just one minute is exceeded, it is decided, from the storage contents of the hand motion state memory 430, whether or not the second sleep state is set (Step 534). If the second sleep state is set, only the hour hand and the minute hand are advanced by one minute (Step 535). If the second sleep is not set, the returning counter (CM) 458 is advanced by one (one minute) (Step 536).

Then, four seconds are added to the returning second counter (CS) 457 (Step 537).

Then, it is decided whether or not the full sleep transition timer (C2) 462 is set to a predetermined upper bound (Step 538). In order to perform a transition to the full sleep state after 10 minutes pass since the second sleep is started, for example, the upper bound is obtained when C2 indicates 10. The upper bound value of the full sleep transition timer counter (C2) 462 is properly set based on the relationship between the storage level (the residual level) and the level of consumed power of the electronic timepiece.

If the full sleep transition timer (C2) 462 is set to the upper bound, the hand motion mode is set to the full sleep mode (Step 540). If not so, the hand motion mode is set to the second sleep mode and is continued (Step 539).

Thus, the processing of the detection timing is ended (Step 541).

While the one-second hand motion and the modulated hand motion (four-second hand motion) have been switched depending on whether the power generating means is set to the power generating state or the non-power generating state, that is, whether or not the absolute value of a difference in an electric potential between both terminals of the power generating means is greater than 0 in the fourth embodiment, the above-mentioned hand motion state may be switched depending on whether the absolute value of the difference in an electric potential is greater than a predetermined value (for example, 0.5 V).

According to the fourth embodiment, even if the electronic timepiece is left for a long period of time, the control means automatically stops the second hand or all the hands depending on the power generating state of the power generating means or the storage level of the storage means, thereby reducing the level of consumed power when the electronic timepiece is left or the like. Consequently, it is possible to immediately perform accurate time display during next carrying without losing a timing function.

INDUSTRIAL APPLICABILITY

If the present invention provides an electronic timepiece for displaying a time by power generated by power generating means for converting an energy supplied from the outside into power, it can be widely applied to various electronic timepieces such as a table timepiece and a wall timepiece as well as a wristwatch. Furthermore, the present invention can also be applied to a digital timepiece for displaying a time in digital display as well as an analog timepiece for displaying a time by a second hand, a minute hand and an hour hand.

What is claimed is:

1. An electronic timepiece comprising:

power generating means for generating power, control means electrically connected to the power generating means and actuated on receipt of a power supply from the power generating means, storage means electrically connected to the power generating means and the control means for storing the power generated by the power generating means and supplying the power to the control means, time display means electrically connected to the control means for displaying a time by an operation of the control means, detecting means electrically connected to the power generating means for detecting a state of the power generating means, deciding means electrically connected to the detecting means for deciding whether or not the power generating means generates power based on a detection signal sent from the detecting means, and switch means for selectively switching a flow of current supplied from the power generating means to the detecting means, wherein said control means controls such that a power generating state of the power generating means is displayed by the time display means based on a decision of the deciding means when the current flows to the detecting means by the switch means.

2. The electronic timepiece having a power generating function according to claim 1, wherein the detecting means serves to detect a difference in an electric potential between two terminals of the power generating means.

3. The electronic timepiece having a power generating function according to claim 2, wherein the deciding means decides whether or not an absolute value of the difference in an electric potential is greater than a predetermined value and causes the display means to display the power generating state when the absolute value of the difference in an electric potential is greater or smaller than the predetermined value.

4. The electronic timepiece having a power generating function according to claim 1, wherein the display means displays the power generating state by motion of a hand for displaying a time.

5. The electronic timepiece having a power generating function according to claim 1, wherein the display means displays the power generating state in digital display.

6. The electronic timepiece having a power generating function according to claim 1, wherein a time display operation of the control means is changed depending on an generated power level by the power generating means.

7. The electronic timepiece having a power generating function according to claim 1, wherein a time display operation is carried out by an ordinary hard motion when an absolute value of a generated power level by the power generating means is greater than a predetermined value, and is carried out by a hand motion which is different from an ordinary hand motion when the absolute value is smaller than the predetermined value.

8. The electronic timepiece having a power generating function according to claim 7, wherein the detecting means changes the time display operation by comparing the absolute value of the difference in an electric potential between terminals of the power generating means with the predetermined value.

9. The electronic timepiece having a power generating function according to claim 1, wherein switching of the switch means is carried out in a timing preset to the deciding means.

10. The electronic timepiece having a power generating function according to claim 1, wherein switching of the switch means is manually carried out.

11. The electronic timepiece having a power generating function according to claim 1, further comprising booster means capable of boosting a power generating voltage applied from the power generating means, thereby outputting a voltage to the control means or the storage means.

12. The electronic timepiece having a power generating function according to claim 1, wherein the power generating means is a power generator for converting a temperature difference into power.

13. The electronic timepiece having a power generating function according to claim 1, wherein the power generating means is a solar cell for converting a light energy into power.

14. The electronic timepiece having a power generating function according to claim 1, wherein the power generating means is a mechanical type power generator for converting a rotational energy of an oscillating weight into power.

15. An electronic timepiece having a power generating function comprising:

power generating means for generating power, control means electrically connected to the power generating means and actuated on receipt of a power supply from the power generating means, storage means electrically connected to the power generating means and the control means for storing the power generated by the power generating means and supplying energy to the control means, time display means electrically connected to the control means for displaying a time by an operation of the control means, detecting means electrically connected to the power generating means for detecting a state of the power generating means, deciding means electrically connected to the detecting means for deciding whether or not the power generating means generates power based on a detection signal sent from the detecting means, and storage detecting means electrically connected to the storage means for detecting a storage state of the power stored in the storage means so that the state of the power generating means is displayed on the time display means based on the energy stored in the storage means detected by the storage detecting means and a decision by the deciding means.

16. The electronic timepiece having a power generating function according to claim 15, wherein the deciding means has a function of comparing a difference in an electric potential between terminals of the storage means with a predetermined difference in an electric potential, thereby changing a time display operation.

17. The electronic timepiece having a power generating function according to claim 15, wherein an operation of a hand is changed in a predetermined timing depending on a power level stored in the storage means.

18. The electronic timepiece having a power generating function according to claim 15, wherein an ordinary time display is carried out when an absolute value of a generated power level by the power generating means is greater than a predetermined value, and a time display operation to be performed by the control means is changed depending on a power level stored in the storage means when the absolute value of the generated power level by the power generating means is equal to or smaller than the predetermined value.

19. The electronic timepiece having a power generating function according to claim 15, wherein an ordinary time display operation is carried out irrespective of a power level of the storage means when the power generating means continuously works for a predetermined time to generate power greater than a predetermined power level.

20. The electronic timepiece having a power generating function according to claim 15, wherein even if an absolute value of a generated power level by the power generating means is equal to or smaller than a predetermined value, an ordinary time display operation is carried out for a predetermined time irrespective of the power level of the storage means and the time display operation is changed after the time passes.

21. The electronic timepiece having a power generating function according to claim 15, wherein an ordinary time display operation is carried out when an absolute value of a power level of the storage means is greater than a predetermined value and the absolute value of the generated power level by the power generating means is greater than the predetermined value.

22. The electronic timepiece having a power generating function according to claim 15, wherein when an absolute value of the generated power level by at least one of the power generating means and an absolute value of the power level stored in the storage means is smaller than a predetermined value, a part of a time display operation or a whole time display operation to be performed by the control means is stopped to reduce a power consumption.

23. The electronic timepiece having a power generating function according to claim 22, wherein the deciding means monitors a power generating stage of the power generating means and a storage state of the storage means with passage of time, measures an elapsed time since the absolute value of the power level stored in the storage means becomes smaller than the predetermined value, and stops a second hand when the elapsed time exceeds a predetermined time if the absolute value of the generated power level by the power generating means is smaller than the predetermined value.

24. The electronic timepiece having a power generating function according to claim 23, wherein if a state in which the absolute value of the generated power level by the power generating means is smaller than the predetermined value and the absolute value of the power level stored in the storage means is smaller than the predetermined value continues for a predetermined time after the second hand is stopped, all hands are stopped.

25. The electronic timepiece having a power generating function according to claim 22, wherein the control means is subsequently operated after the second hand or all the hands are stopped, thereby counting a stop time by the control means.

26. The electronic timepiece having a power generating function according to claim 25, wherein the second hand or all the hands are driven based on the counting when restarting a hand motion.

27. The electronic timepiece having a power generating function according to claim 15, wherein the power generating means is selected from the group consisting of a power generator for converting a temperature difference into power, a solar cell for converting a light energy into power, and a mechanical type power generator for converting a rotational energy of an oscillating weight into power.

* * * * *